US007641544B2

(12) United States Patent
Perkitny et al.

(10) Patent No.: US 7,641,544 B2
(45) Date of Patent: Jan. 5, 2010

(54) COIN BANK

(75) Inventors: Jerzy Perkitny, Lakewood, OH (US); William J. Knox, Jr., Painesville, OH (US)

(73) Assignee: Mag-Nif Incorporated, Mentor, OH (US)

( * ) Notice: Subject to any disclaimer, the term of this patent is extended or adjusted under 35 U.S.C. 154(b) by 111 days.

(21) Appl. No.: 11/522,234

(22) Filed: Sep. 15, 2006

(65) Prior Publication Data

US 2008/0070490 A1 Mar. 20, 2008

(51) Int. Cl.
*G07D 9/06* (2006.01)

(52) U.S. Cl. ..... 453/61

(58) Field of Classification Search ..... 453/61, 453/3, 16, 59; 229/87.2
See application file for complete search history.

(56) References Cited

U.S. PATENT DOCUMENTS

| | | | | |
|---|---|---|---|---|
| 3,319,636 | A | 5/1967 | Verbeke | |
| 3,906,964 | A | 9/1975 | Ushio et al. | |
| 4,092,990 | A | 6/1978 | Bayne | |
| 4,095,607 | A * | 6/1978 | Newton et al. | 453/61 |
| 4,122,860 | A * | 10/1978 | Weisman | 453/8 |
| 4,157,139 | A * | 6/1979 | Bjork | 209/552 |
| 4,249,553 | A * | 2/1981 | Sentoku | 453/62 |
| 4,360,034 | A | 11/1982 | Davila et al. | |
| 4,586,522 | A * | 5/1986 | Taipale et al. | 453/10 |
| 5,059,153 | A * | 10/1991 | Goi | 453/11 |
| 5,902,178 | A * | 5/1999 | Perkitny | 453/9 |
| 6,095,313 | A | 8/2000 | Molbak et al. | |
| 6,099,401 | A * | 8/2000 | Perkitny | 453/9 |
| 6,165,063 | A | 12/2000 | Perkitny | |
| 6,443,829 | B1 | 9/2002 | Perkitny | |
| 6,524,179 | B2 * | 2/2003 | Perkitny et al. | 453/9 |
| 6,609,604 | B1 * | 8/2003 | Jones et al. | 194/302 |
| 6,638,157 | B2 | 10/2003 | Perkitny | |
| 6,755,731 | B2 * | 6/2004 | Lee | 453/59 |
| 6,830,509 | B2 | 12/2004 | Perkitny | |

(Continued)

FOREIGN PATENT DOCUMENTS

| | | |
|---|---|---|
| GB | 16577 | 3/1904 |

(Continued)

OTHER PUBLICATIONS

Mag-Nif Catalog © 2002, pp. 1-16, including cover page and back page.

*Primary Examiner*—Patrick Mackey
*Assistant Examiner*—Mark Beauchaine
(74) *Attorney, Agent, or Firm*—Fay Sharpe LLP

(57) ABSTRACT

The present invention relates to a coin bank. The coin bank includes a housing and a coin sorting mechanism mounted to the housing. At least two rows of coin tubes, for holding associated sorted coins, are selectively positioned in the housing. Each row includes a plurality of coin tubes meant for holding sorted coins of multiple denominations, wherein a plurality of columns of coin tubes, each holding one denomination of associated sorted coins, is defined. The coin tubes in each column is positioned at descending levels. At least two deflector wall sections are mounted to the housing. Each deflector wall section is positioned generally above a respective one of the at least two rows of coin tubes. Each deflector wall section directs a coin into a respective coin tube. A respective exit aperture is defined below a lower edge of each respective deflector wall section and above an upper edge of a respective coin tube. The descending levels of coin tubes allow a coin to travel away from a first row of coin tubes and contact a respective deflector wall section of a next row of coin tubes.

31 Claims, 26 Drawing Sheets

U.S. PATENT DOCUMENTS

| | | | | |
|---|---|---|---|---|
| 6,966,827 | B2 | 11/2005 | Perkitny | |
| 7,017,729 | B2 | 3/2006 | Gerrity et al. | |
| 2004/0074737 | A1 * | 4/2004 | Yang | 194/338 |
| 2004/0219873 | A1 | 11/2004 | Perkitny | |

FOREIGN PATENT DOCUMENTS

| | | | |
|---|---|---|---|
| GB | 1 026 883 | A | 4/1966 |
| GB | 2 138 192 | A | 10/1984 |

* cited by examiner

COIN BANK

BACKGROUND

The present invention relates to a coin bank. More particularly, the present invention relates to a coin back which separates, sorts and stores five different denominations of coins.

Coin sorting devices are generally known. A user places one or more coins in a hopper or similar coin receiving location. A coin separating mechanism separates the coins and dispenses the coins, typically one at a time, from the hopper into a coin sorting mechanism. The coin sorting mechanism classifies the coins by their diameter. Coins of a particular diameter, and consequently of a particular denomination, are directed into the appropriate one of a plurality of sorted coin storage containers. Such coin storage containers are typically cylindrical or tubular in shape and are generally of a size corresponding to standard coin rolling wrappers that hold anywhere from twenty to fifty coins. The containers are accessible in order that the sorted coins can be removed.

Coin separating mechanisms employing rotating coin separator plates are known. One such separator plate is in the form of a disk having four U-shaped notches formed in its periphery. Each notch is sized to be larger in width than the largest coin which is to be sorted by a coin sorter. The separator plate is mounted on a planar base of the receiver, the base being fixed to an upper housing at a slope of approximately 45° from the horizontal. Coins tend to come to rest in the lowermost portion of the receiver with their faces contacting the separator plate or the base. When the separator plate is rotated, it will engage a coin with the edge of one of its notches and carry the coin upward to an opening formed in the base where the coin will fall through into an upper portion of a coin ramp leading to a sorting ramp. The ramp has apertures of increasing size through which the coins fall into sorted coin containers.

However, this known coin separating mechanism is not capable of sorting coins of five different denominations. Moreover, the known mechanism does not employ a removable drawer in which the coin containers are held in order to allow an easy removal of the coin containers from the housing of the coin bank. The known coin sorting devices also fail to retard the coins from assuming an orientation other than normal to a respective longitudinal axis of each coin tube. Another deficiency with known coin sorting devices is their inability to prevent an overflow of the sorted coin containers. Known devices continue to sort and deliver coins to the sorted coin containers even though the sorted coin containers are full. Such additional coins spill over, resulting in many instances in a mess.

Accordingly, it is desirable to develop a new and improved coin bank capable of sorting coins of five different denominations which would overcome the foregoing deficiencies and others, as well as providing better and more advantageous overall results.

BRIEF DESCRIPTION

In accordance with an aspect of the present invention, a coin bank is provided. The coin bank comprises a housing and a coin sorting mechanism mounted to the housing. At least two rows of coin tubes, for holding associated sorted coins, are selectively positioned in the housing. Each row comprises a plurality of coin tubes meant for holding sorted coins of multiple denominations, wherein a plurality of columns of coin tubes, each holding one denomination of associated sorted coins, is defined. The coin tubes in each column are positioned at descending levels. At least two deflector wall sections are mounted to the housing. Each deflector wall section is positioned generally above a respective one of the at least two rows of coin tubes. Each deflector wall section directs a coin into a respective coin tube. A respective exit aperture is defined below a lower edge of each respective deflector wall section and above an upper edge of a respective coin tube. The descending levels of coin tubes allow a coin to travel away from a first row of coin tubes and contact a respective deflector wall section of a next row of coin tubes.

In accordance with another aspect of the present invention, a coin bank includes a housing and a coin sorting assembly mounted to the housing. The housing includes a coin receiving area for receiving associated coins. The coin sorting assembly is located beneath the coin receiving area. A plurality of rows of coin tubes hold the associated sorted coins. The coin tubes form columns of coin tubes each holding one denomination of the associated sorted coins. The coin tubes in each column are positioned at descending levels. A sorted coin directing assembly includes a first backstop wall section mounted to the housing and a first deflector wall section mounted to the housing and spaced from the first backstop wall section. An exit aperture is defined between the first backstop wall section and the first deflector wall section. The exit aperture allows a coin located above a full coin tube to move to an adjacent coin tube in the column. A second deflector wall section is mounted to the housing for constraining the associated sorted coins to move towards the adjacent coin tube in the column. A second backstop wall section is mounted to the housing and spaced from the second deflector wall section.

In accordance with yet another aspect of the present invention, a coin bank includes a housing for receiving unsorted coins. A coin sorting assembly and support member are mounted in the housing. A plurality of coin tubes is selectively mounted on the support member including at least one coin tube for each denomination of coins to be sorted. An agitator mechanism is operably connected to the support member. The agitator mechanism moves associated coins held in the plurality of coin tubes to retard the associated coins from assuming an orientation other than approximately normal to a longitudinal axis of the respective coin tube.

In accordance with still yet another aspect of the present invention, a coin bank comprises a housing. A coin sorting assembly is mounted to the housing. A shaker box is removably mounted to the housing. The shaker box comprises a support surface for supporting a plurality of coin tubes for holding associated coins sorted by the sorting assembly. A shaker mechanism is mounted to the shaker box. The shaker mechanism moves the associated coins held in the plurality of coin tubes to retard the associated coins from assuming an orientation other than normal to a respective longitudinal axis of each of the plurality of coin tubes.

In accordance with still yet another aspect of the present invention, a coin bank comprises a housing for receiving unsorted coins. A coin sorting assembly is mounted to the housing. A support member is selectively mounted to the housing. A plurality of coin tubes is selectively mounted to the support member. The plurality of coin tubes are arranged in a plurality of rows for holding associated sorted coins. The support member is movable to at least two positions with respect to the housing. A respective backstop is associated with each of the plurality of rows of coin tubes. A downstream-most row of coin tubes may not have a backstop associated with it. In a first position, the plurality of rows of coin tubes are located adjacent to the respective backstop. In a second position, the plurality of rows of coin tubes are generally offset from the first position. The movement of the support member from the first position to the second position allows at least one retained coin located above an upstream coin tube of the plurality of rows of coin tubes to contact the respective backstop and fall towards a downstream coin tube of the same denomination in a downstream row of coin tubes.

Still other non-limiting aspects of the present invention will become apparent from a reading and understanding of the description of the preferred embodiments hereinbelow.

BRIEF DESCRIPTION OF THE DRAWINGS

The invention may take physical form in various components and arrangements of components, and in various steps and arrangements of steps. The drawings are only for purposes of illustrating embodiments of the invention and are not to be construed as limiting the invention.

DETAILED DESCRIPTION

It should, of course, be understood that the description and drawings herein are merely illustrative and that various modifications and changes can be made in the structures disclosed without departing from the spirit of the invention. It will also be appreciated that the various identified components of the coin bank disclosed herein are merely terms of art that may vary from one manufacturer to another and should not be deemed to limit the present invention.

Figure 1:
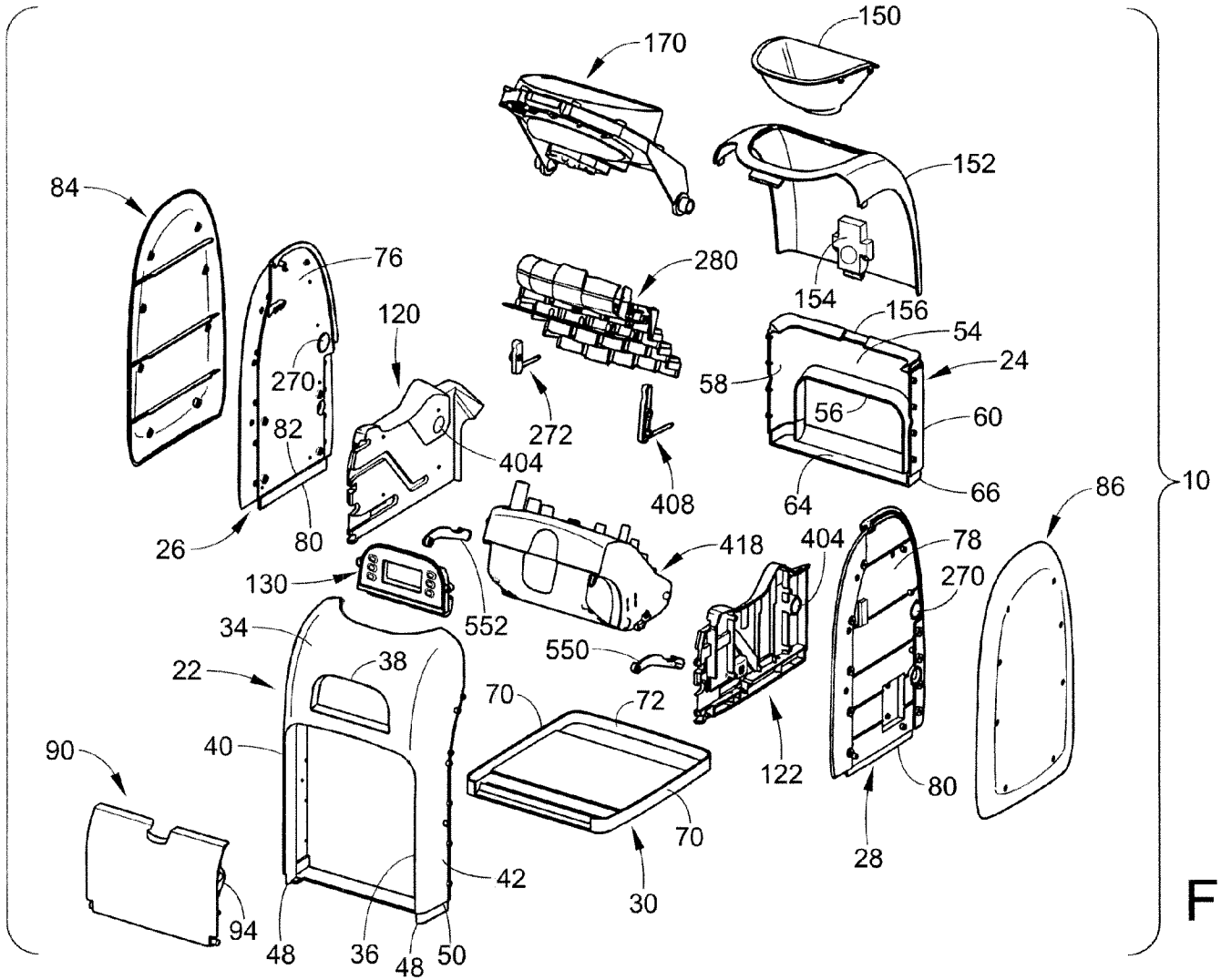
FIG. 1 is a partial exploded perspective view of a coin bank according to the present invention.
Figure 1A:
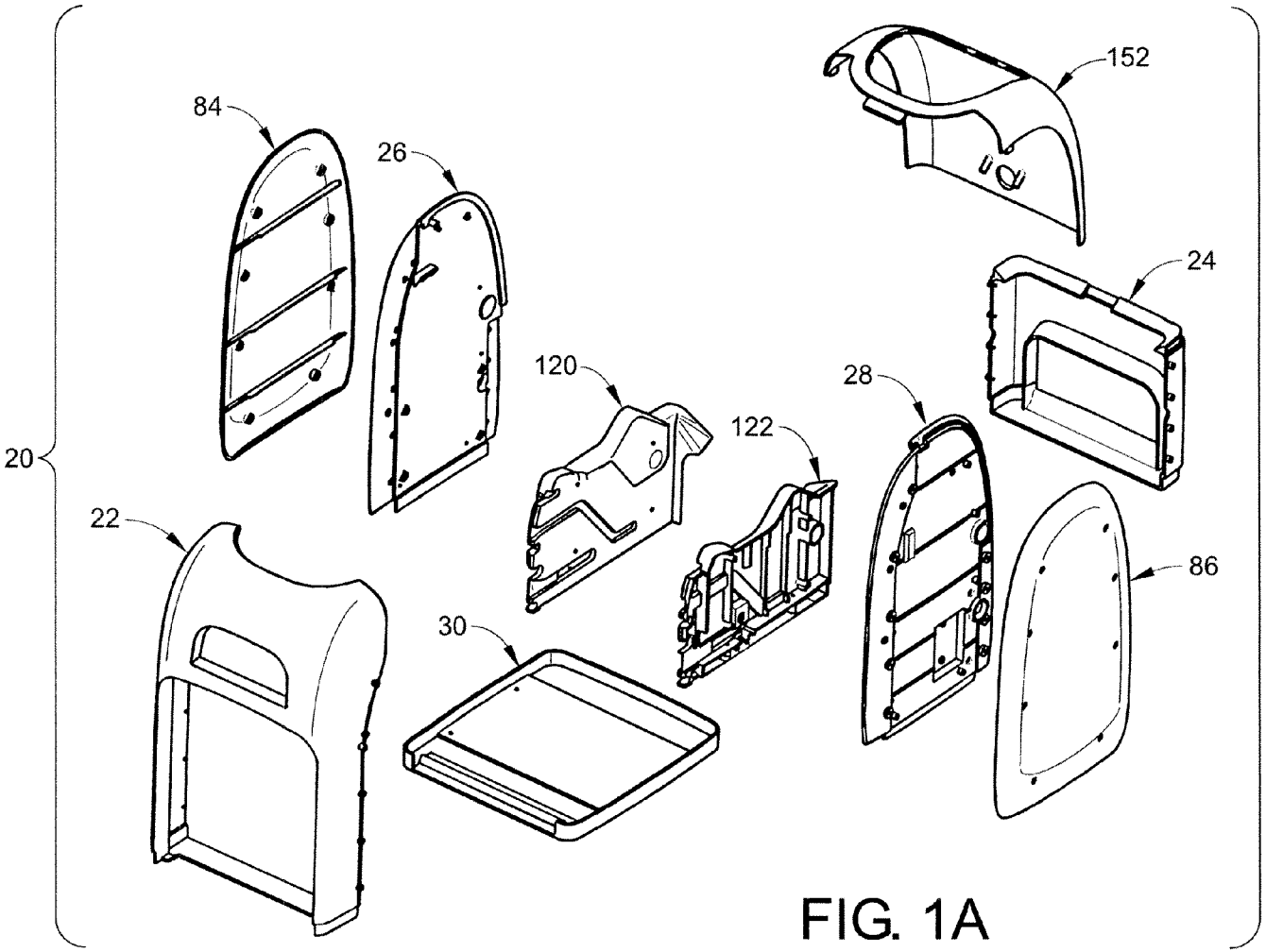
FIG. 1A is a detailed exploded perspective view of a housing of the coin bank of FIG. 1.
Figure 2:
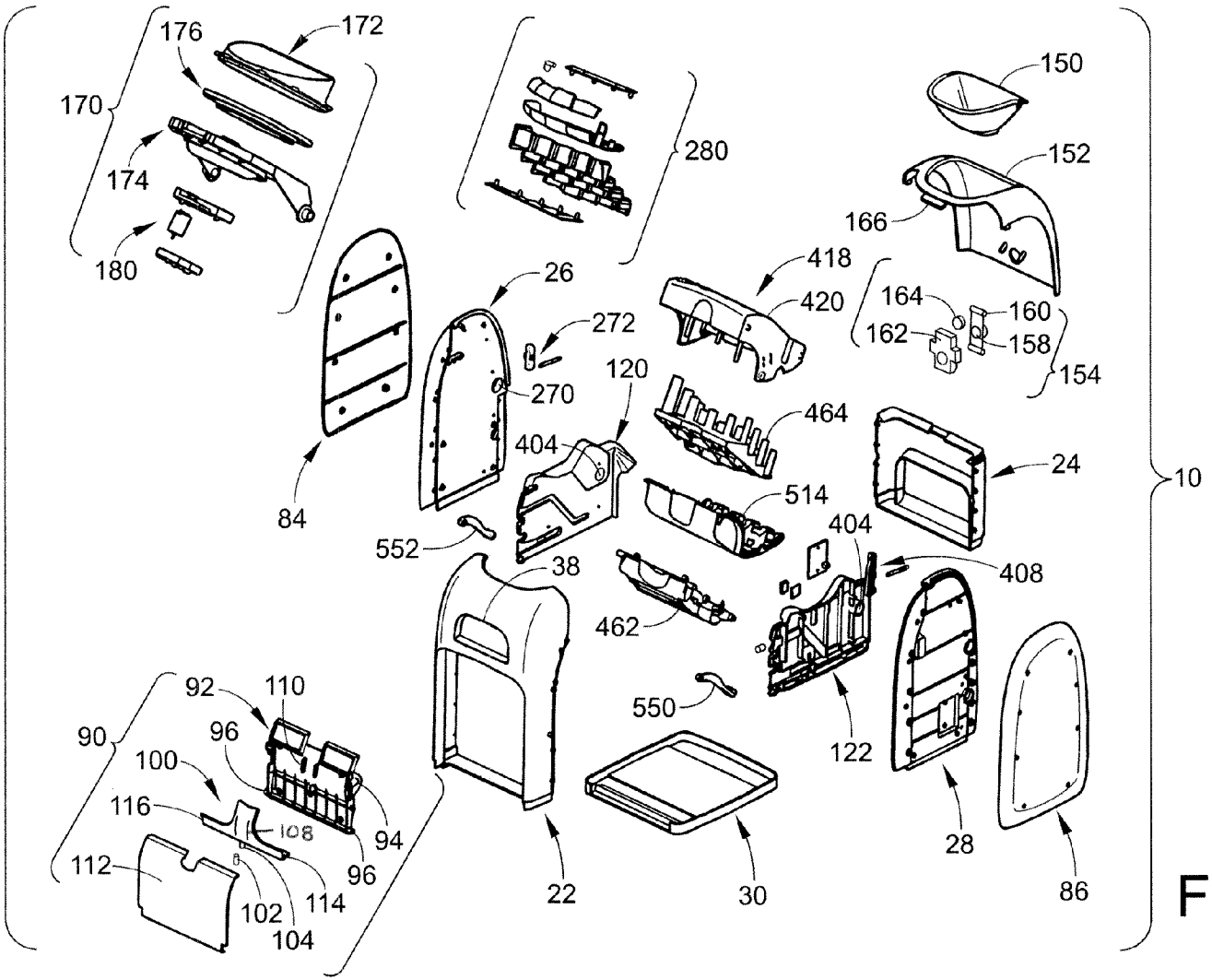
FIG. 2 is a detailed exploded perspective view of the coin bank of FIG. 1.
Figure 2A:
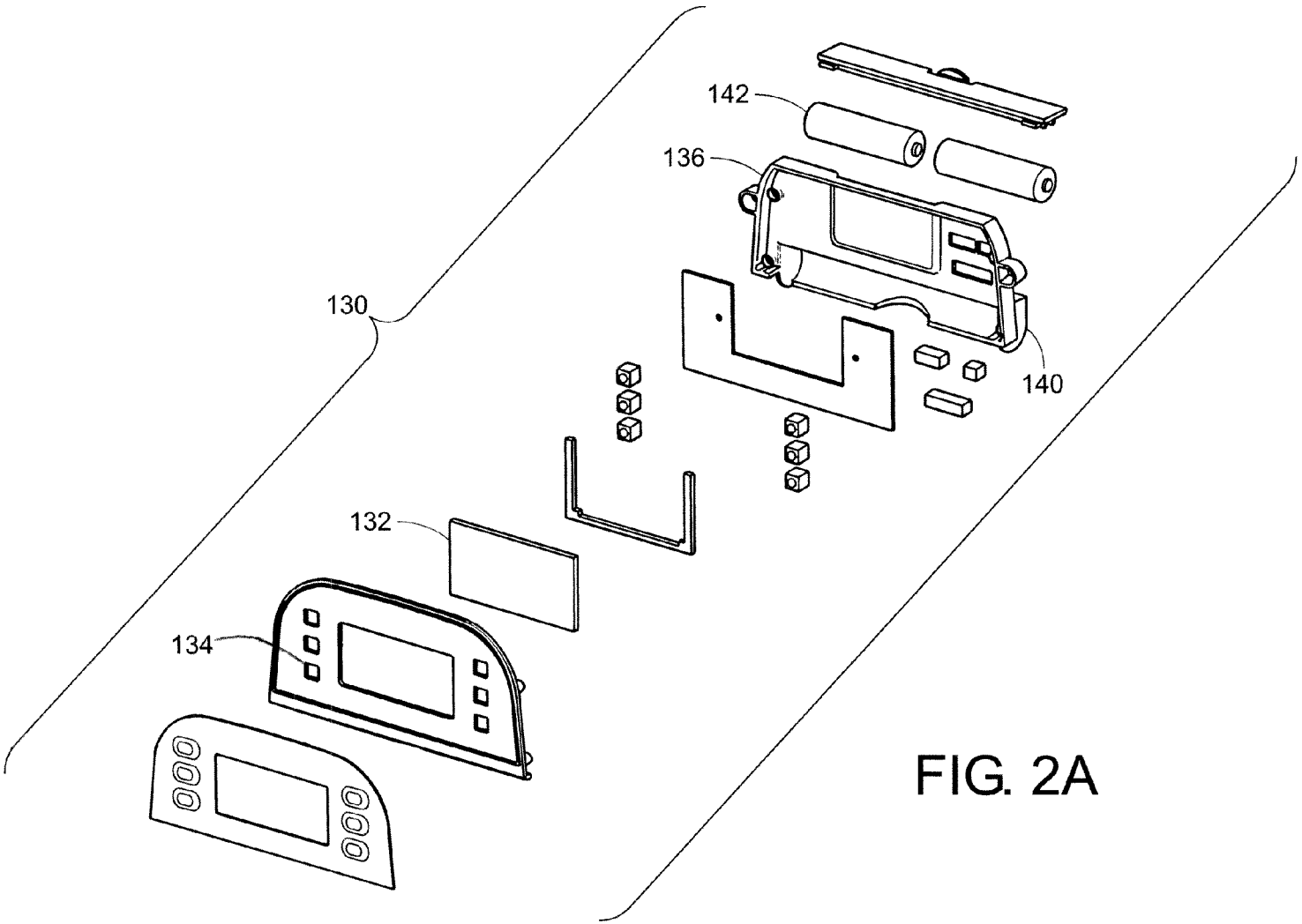
FIG. 2A is a detailed exploded view of a display panel component of the coin bank of FIG. 1.

Referring now to the drawings, wherein the showings are for purposes of illustrating several embodiments of the invention only and not for purposes of limiting the same, FIGS. 1 and 2 show an exploded view of a coin bank 10, and the individual components thereof, in accordance with a first embodiment of the disclosure. The coin bank includes a housing 20 for receiving unsorted coins. The housing 20 can be made from plastic or a similar conventional material. For example, a portion of the housing can be made from a transparent plastic such that the operation of the coin bank 10 can be easily viewed by an operator or a bystander. The housing includes a front panel 22, a rear panel 24, and side panels 26, 28, each being mounted on a base 30.

More particularly in this respect, the front panel 22 includes a front wall portion 34 having a first opening 36 and a second opening 38. Generally arcuate side portions 40 and 42 extend from the front wall portion, the lower edges of which include a mounting flange 48 which is inwardly recessed to provide a shoulder 50 between the side portions and mounting flange. Similar to the front panel, the rear panel 24 includes a rear wall portion 34 having an opening 56, arcuate side portions 58 and 60 and a bottom wall 64. The bottom wall is recessed inwardly of the rear wall and side wall portions to provide a shoulder 66. The mounting flanges 48 and the bottom wall 64 are received inwardly adjacent side and rear walls 70 and 72, respectively, of the base 30 with each shoulder 50, 66 resting on the upper edges of the walls 70, 72.

Each side panel 26 and 28 includes a respective wall portion 76 and 78, the lower edges of which also include a mounting flange 80 which is inwardly recessed to provide a shoulder 82 between the each wall portion and mounting flange. The mounting flanges 80 are received inwardly adjacent the side walls 70 of the base 30 with each shoulder 82 resting on the upper edges of the side walls 70. Side covers 84 and 86 can be mounted to the side panels 26 and 28 via conventional means, such as threaded fasteners.

With continued reference to FIGS. 1 and 2, a door assembly 90 is pivotally mounted in the first opening 36 of the front panel 22. The door assembly includes a plate 92 having a pair of projections 94 (only one being shown) and a pair of stems 96 projecting away from opposed sides of the plate. A push button 100 is attached to the plate. The push button, which is biased upwardly by a spring 102 having one end attached to the plate 92 and the other received over a pin 104, includes a pair of elongated slots 108 dimensioned to receive tabs 110 extending from the plate. The tabs at least partially limit the movement of the push button. A cover 112 is attached to the plate 92. As will be described in greater detail below, the push button 100 further includes first and second opposed arms 114 and 116, respectively, which releasably secure the door assembly 90 to guiding members 120 and 122 secured to the respective side panels 26 and 28.

Received in the second opening 38 of the front panel 22 is a display panel component 130 which can, for example, include a display screen 132 for selectively displaying information in response to activating one or more of a plurality of push buttons 134. The display component can be programmed, such as through the use of a microprocessor, to provide such information as, for example, the total number of coins in the bank, the total number of coins in each value category, the total dollar value in the bank and/or in the individual coin tubes, and the like. A housing 136 for housing the display panel component 130 is mounted to front panel 22. The housing includes a battery compartment 140 which can receive conventional batteries 142 for providing power to the display panel component.

A generally funnel-shaped coin receiver 150 for receiving unsorted coins is mounted on a cover 152, which is removably attached to the coin bank housing 20. In particular, a lower end of the cover includes a release button assembly 154 which engages an underside of a recess 156 located on an upper end of the rear panel 24. The release button assembly includes an L-shaped arm 158 having a push button 160 pivotally secured at one end in a housing 162. A spring 164 is mounted in the housing for biasing the arm 158. An upper end of the cover includes a tab 166 for engaging an underside of an upper end of the front panel 22.

Figure 3:
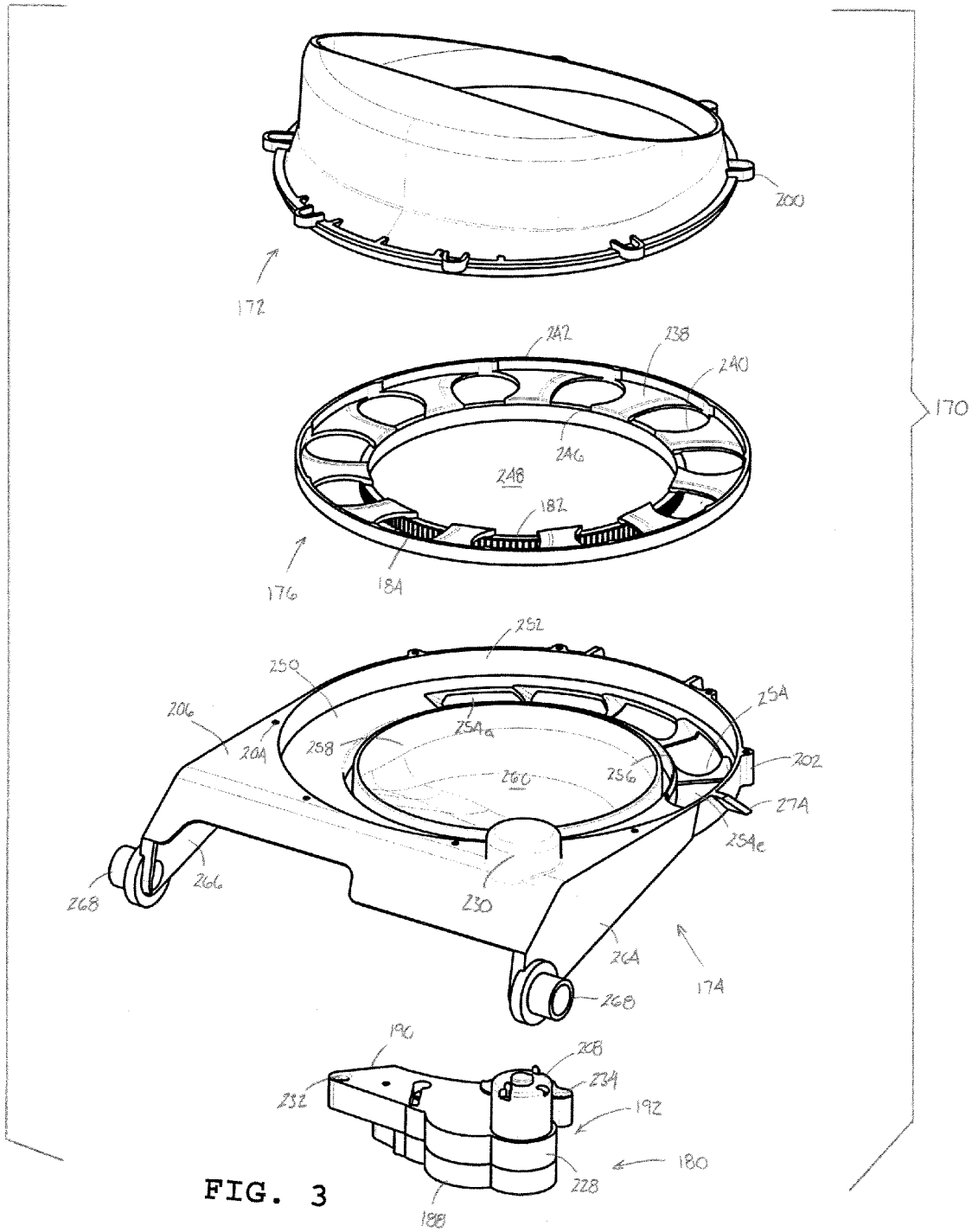
FIG. 3 is an enlarged exploded perspective view of a coin separating and sorting assembly of the coin bank of FIG. 1.
Figure 4:
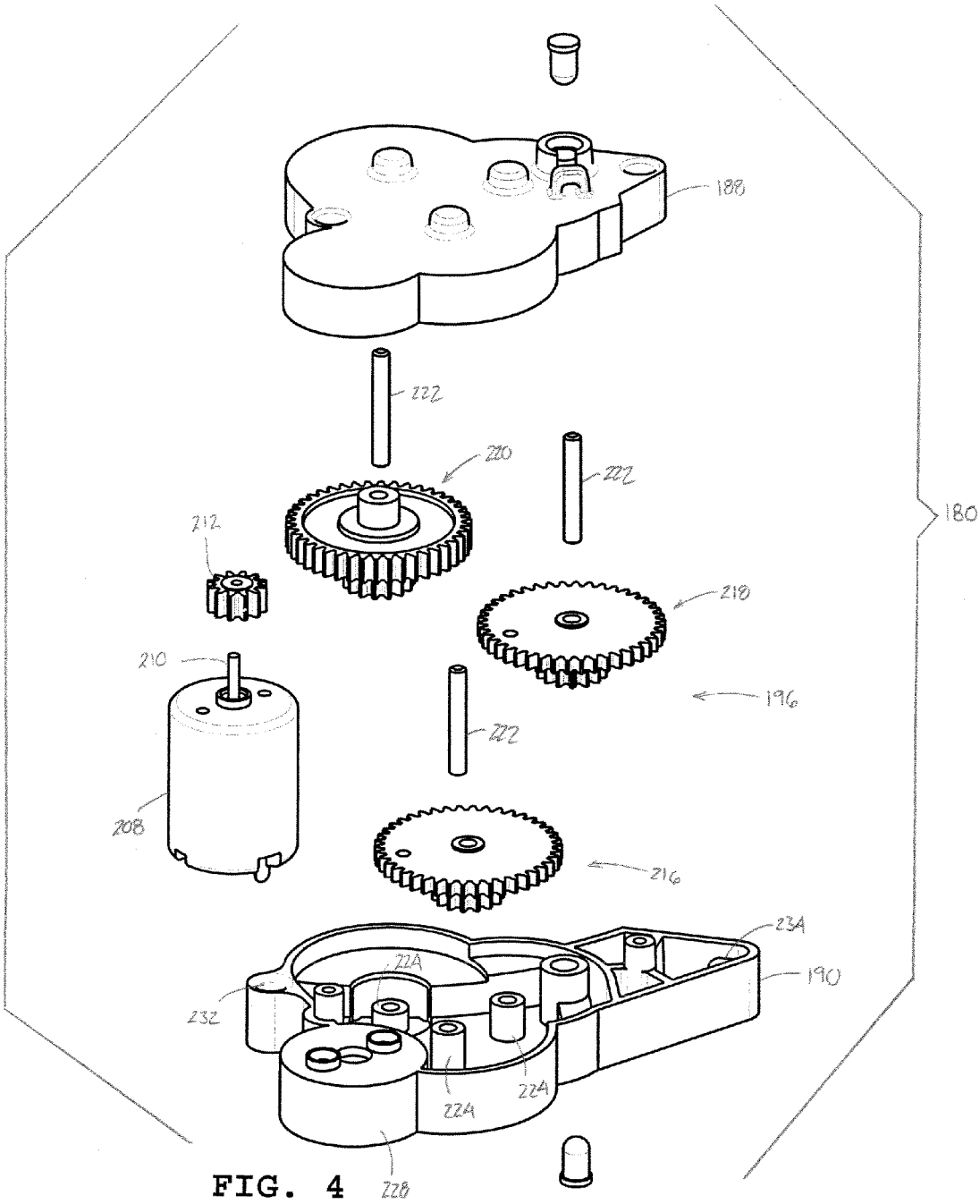
FIG. 4 is an enlarged exploded perspective view of a motor and gear assembly of the coin sorting and separating assembly of FIG. 3.

With reference to FIGS. 3 and 4, a coin sorting assembly 170 is pivotally mounted in the housing 20 beneath the coin receiver. The coin sorting assembly sorts a plurality of coins placed in it according to the diameter of each coin. The coin sorting assembly comprises an upper wheel support 172, a lower wheel support 174, a coin separating wheel 176 captured therebetween and rotatable relative thereto, and a wheel drive motor and gear assembly 180 mounted on the under side of the lower wheel housing.

The separating wheel 176 includes a depending circular flange 182 having gear teeth 184 thereon. When the wheel drive unit 180 is mounted on the under side of the lower wheel support 174, the toothed flange 182 depends at least partially into an opening (not shown) defined by first and second halves 188 and 190, respectively, of a motor housing 192 and into meshing engagement with a gear train 196 (FIG. 4) of the wheel drive unit 180. The upper wheel support 172 is provided with mounting tabs 200 which are at least partially aligned with mounting tabs 202 and spaced apart apertures 204 located on a top surface 206 of the lower wheel support 174. The wheel supports can be interconnected with one another by means of threaded fasteners (not shown) which extend through the upper mounting tabs and threadingly engage the lower mounting tabs and apertures.

As shown in FIG. 4, the wheel drive motor and gear assembly 180 comprises an electric motor 208 including a drive shaft 210 and a spur gear 212 securely mounted to an end of the drive shaft. The gear train 196 comprises a first compound gear 216, a second compound gear 218 and a third compound gear 220. Each compound gear is rotatably mounted in the motor housing 192 by shafts 222 extending through gear apertures, ends of the shafts being received in corresponding bosses 224 located on the respective housing halves 188,190. Each compound gear includes a small gear portion concentrically secured to a large gear portion. In the present embodiment, three compound gears are provided. However, it should be appreciated that more or less than three compound gears can be implemented in a suitable gear train. The second housing half 190 and the lower wheel support 174 each include a well 228 and 230, respectively, for housing a portion of the electric motor 208. The assembled drive unit 180 is mounted on the under side of lower wheel support 174 by threaded fasteners (not shown), extending through openings 232 and 234 in the second housing half 190 and into the under side of the lower wheel support.

With continued reference to FIG. 3, the separating wheel 176 is ring-like and includes a top wall 238 having a plurality of coin openings 240 therethrough. Each of the openings extends from an inner periphery of the sorting wheel 176 to an outer flange 242 thereof and is sized so as to accommodate the largest diameter coin meant to be sorted. If United States coinage is being sorted, the coins are the dime, penny, nickel, quarter, and dollar coins. A set of slots 246 are located in the top wall 238, each slot opening to a respective one of the coin openings 240. The circular flange 182 depends from the inner periphery of the top wall 238 and surrounds an open center portion 248 of the separating wheel. The coins are urged by gravity radially inwardly during rotation of the separating wheel 176 due to the shape of the coin opening 240 and the angle at which the separating wheel is mounted in the coin bank 10.

The underlying wheel support 174 includes an outer wall 250 having an outer skirt 252. Located radially inwardly from the skirt are a series of spaced apertures 254. In the orientation shown in FIG. 3, it is apparent that the apertures are of different coin sizes such that the apertures increase in width clockwise from a smallest width aperture 254*a* to a largest width aperture 254*e*. Positioned radially inwardly from the set of coin apertures 254 is a channel shaped groove 256 which surrounds a central wall portion 258 defining a plateau 260 for directing coins deposited into the lower wheel support from the coin receiver 150 to the coin apertures.

Figure 8:
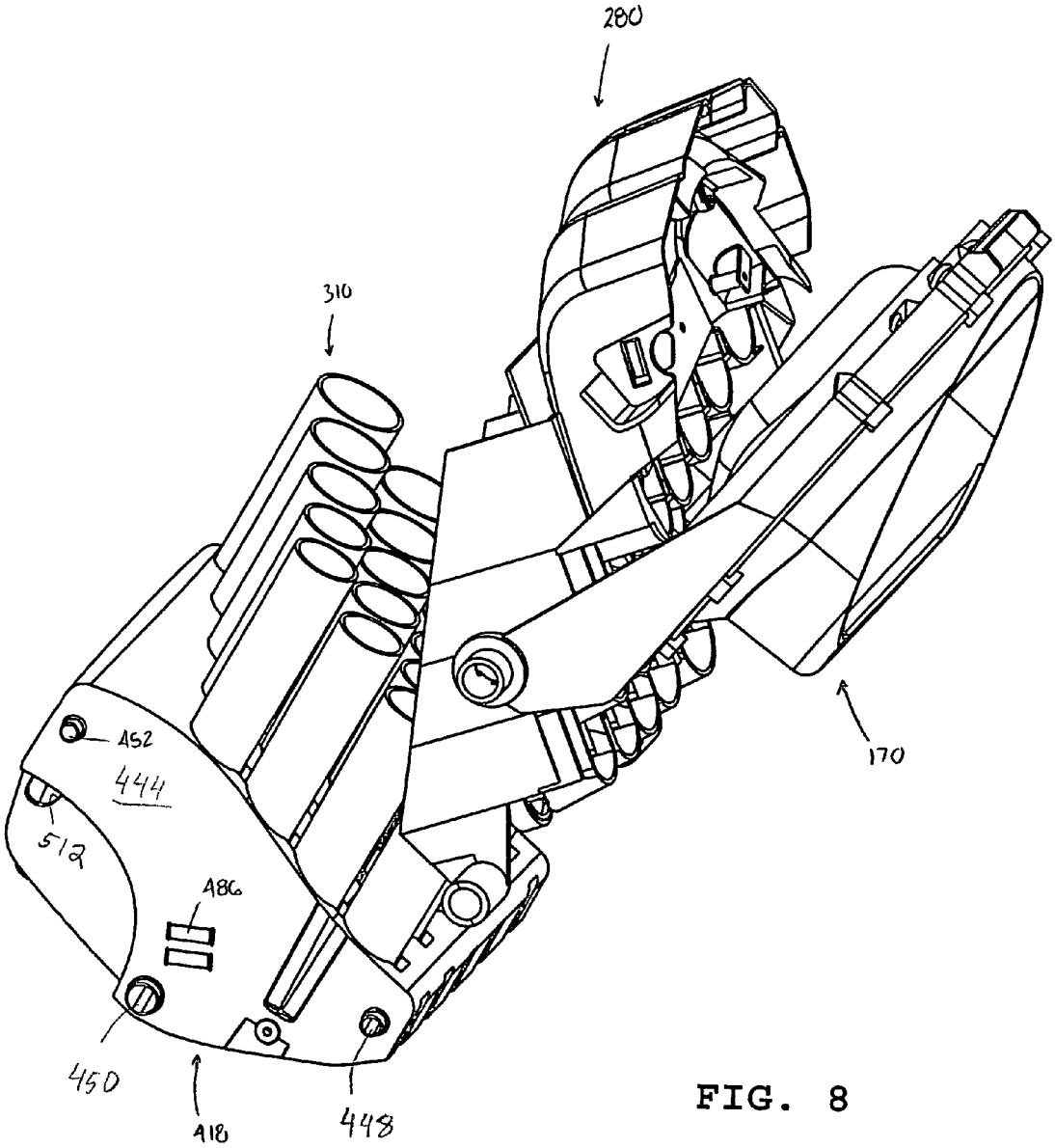
FIG. 8 is an enlarged perspective view the coin separating and sorting assembly, coin slide structure and shaker box of the coin bank of FIG. 1 in a maintenance position.
Figure 18:
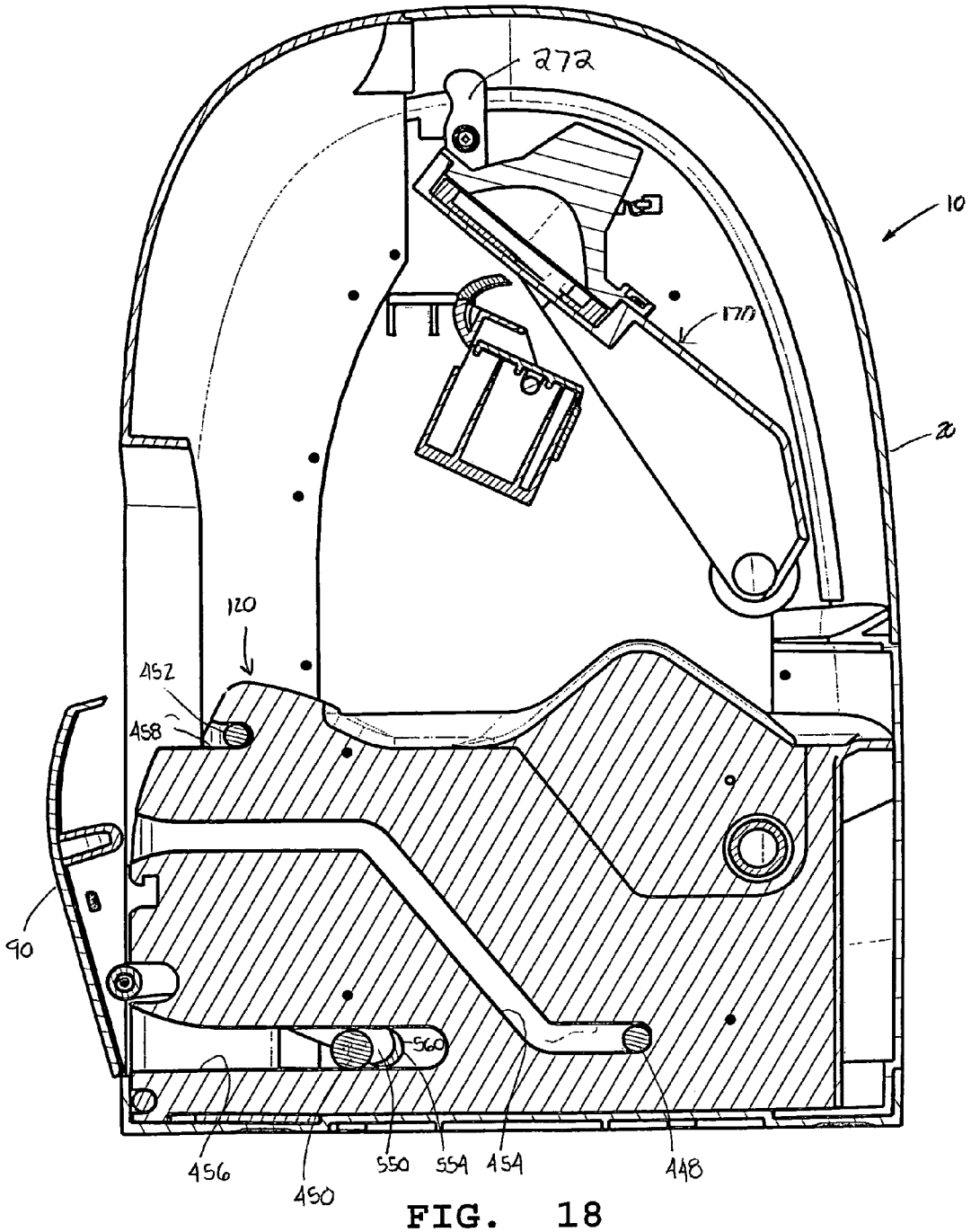
FIG. 18 is an enlarged cross-sectional view of the coin bank of FIG. 13 showing first and second pins of the support member of FIG. 6 being slidingly received in corresponding spaced apart guides located on a housing of the coin bank.

As indicated above, the coin sorting assembly 170 is pivotally mounted to the coin bank housing 20. In particular, the lower wheel support 174 includes opposed side walls 264 and 266 extending from the top surface 206. A lowermost end portion of each side wall includes a stem 268. The stems are pivotally received in corresponding openings 270 (FIG. 2) located on each side panel 26 and 28. Once positioned in the openings, the stems allow the assembled coin sorting assembly 170 to pivot outwardly from the coin bank housing 20 and away from a coin slide assembly 280 (FIG. 5) for access to the coin slide and clearing coins jams located on the coin slide structure (FIG. 8). As shown in FIGS. 1 and 18, a first lock 272 is mounted to the side panel 26. The lock engages a flange 274 extending from the lower wheel support 174 to lock the coin sorting assembly 170 in place, in a use position in housing 20.

Figure 5:
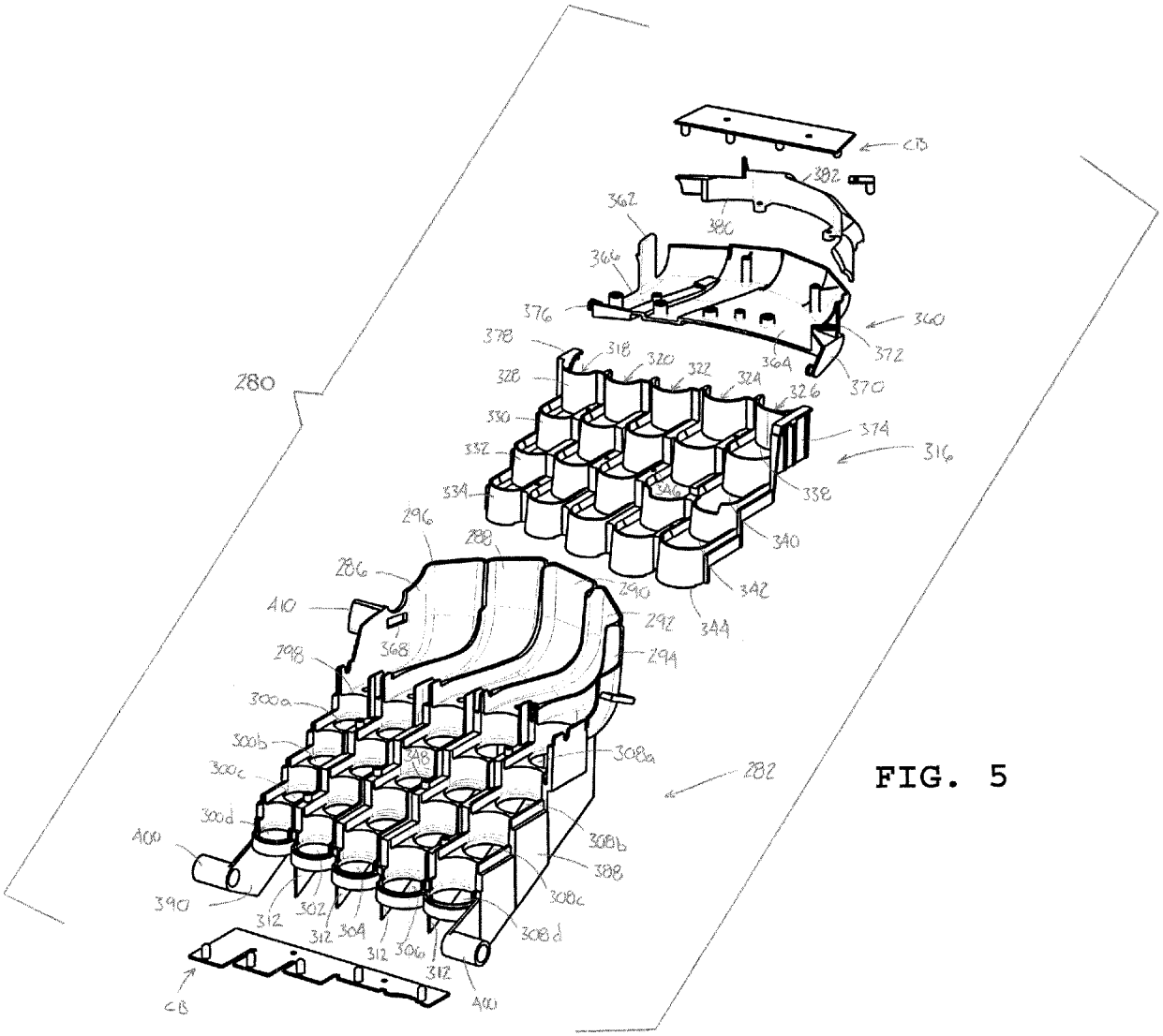
FIG. 5 is an enlarged exploded perspective view of a coin slide structure and coin directing assembly of the coin bank of FIG. 1.

With reference to FIG. 5, the coin slide assembly 280 is pivotally mounted in the coin bank housing 20 and beneath coin sorting assembly 170. The coin slide assembly includes a coin slide 282 provided with five coin sliding surfaces 286, 288, 290, 292, and 294 positioned side by side. These coin sliding surfaces are meant to accommodate five different diameters of coins. Again, if United States coinage is being sorted, the coins are the dime, penny, nickel, quarter, and dollar coins. When such coins are sorted, the dime coin will slide down sliding surface 286, the penny sliding down surface 288, the nickel down surface 290, the quarter down surface 292, and the dollar down surface 294. Coins are fed to these five sliding surfaces from the varying width apertures 254 (FIG. 3) disposed in the lower wheel support or sort surface 174.

Figure 11:
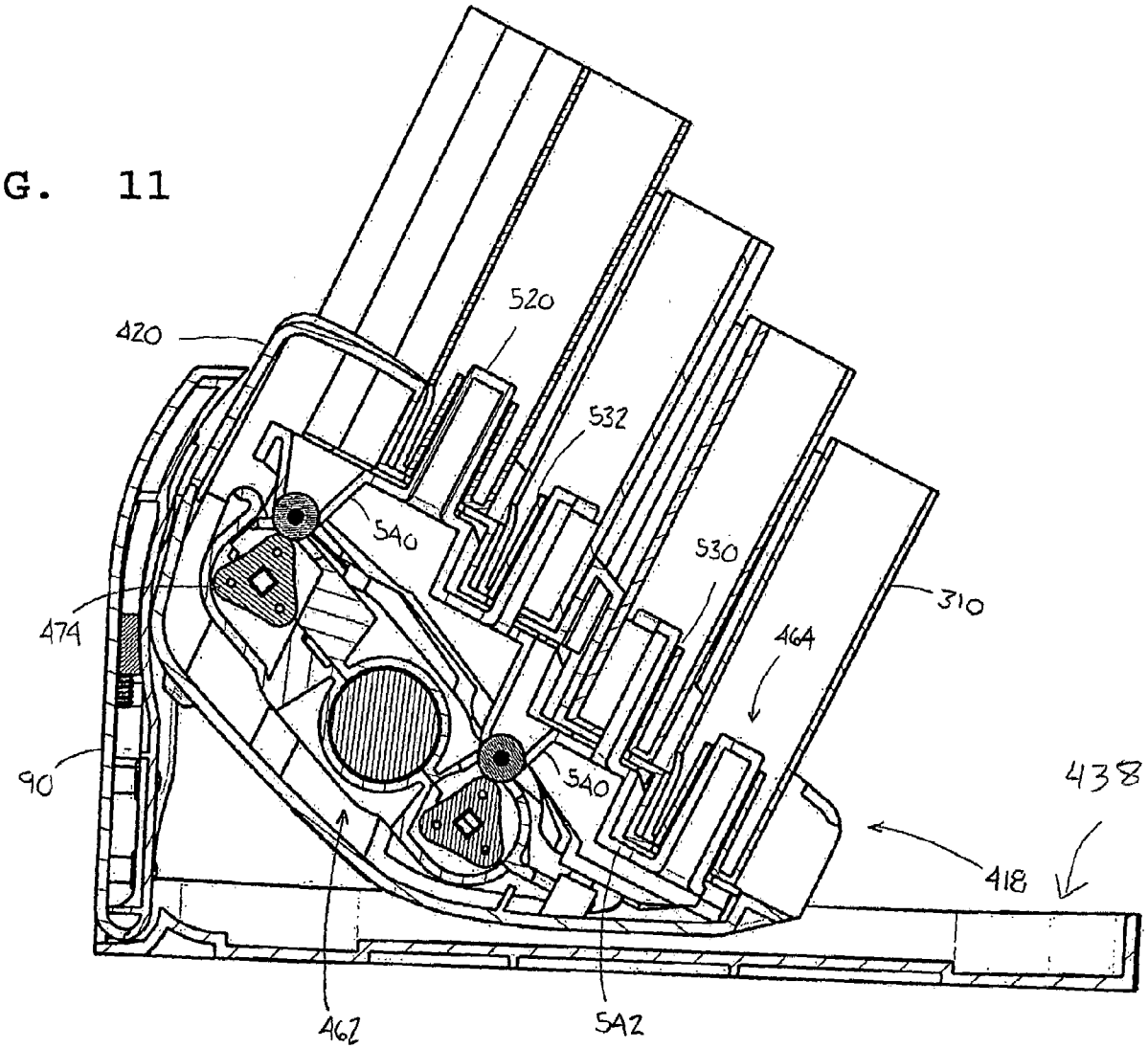
FIG. 11 is an enlarged, partial cross-sectional view of an assembled coin bank of FIG. 1 showing the shaker mechanism of FIG. 6 in a first position.

Each coin slide 286-294 slopes from an upper end 296 to a lower end 298. Positioned at the lower end of each of the coin sliding surfaces 286-294 are a plurality of openings 300, 302, 304, 306, and 308. It should be apparent that the several openings 300-308 are of different diameters, with the opening 300 having the smallest diameter and the opening 308 having the largest diameter. The diameters of the openings are each slightly larger than the diameter of the coin meant to be accommodated in a respective one of the slides. The diameters of the openings generally correspond with the widths of the sorting apertures 254 (FIG. 3) in the lower wheel support 174. It should also be apparent from FIG. 5 that for each coin to be sorted, there are a plurality of descending openings for that coin. For example, as shown in FIG. 5, a dime coin will slide down sliding surface 286. Located at the end of the sliding surface are four spaced apart, cascading and descending coin openings 300*a*-300*d*. Located below the coin openings are coin tubes 310, at least one coin tube for each denomination of coins to be sorted. Four such tubes are shown in FIG. 11. Since the tubes have upper ends located at different heights, coins can cascade from a filled upper tube to a partially empty lower one. As shown in FIG. 5, a plurality of spaced apart, downwardly extending fins 312 are mounted to the coin slide 282 above the plurality of rows of coin tubes 310 and positioned between the columns of coin tubes for preventing cascading coins of one denomination from falling into adjacent coin tubes meant for coins of another denomination.

With continued reference to FIG. 5, the coin slide assembly 280 further includes a deflection wall assembly 316 having a plurality of tube sections 318, 320, 322, 324, and 326. Each tube section includes a plurality of descending deflection wall sections 328, 330, 332, and 334, which are oriented approximately normal to the fins 312, one located above each of the respective coin openings 300-308. To this end, the tube sections are of varying diameters to align with the varying diameter coin tubes 310 and accommodate coins of differing diameters.

Figure 21:
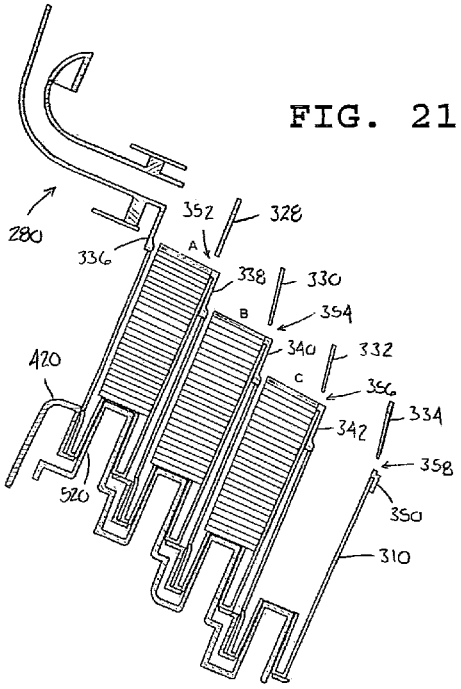
FIGS. 21-24 are partial cross-sectional views of the coin slide structure, the shaker box and a column of descending coin tubes for the same denomination of coins of the coin bank of FIG. 1 in an assembled condition, illustrating a movement of the shaker box from a first position to a second position, which allows at least one retained coin located above an upstream coin tube to contact a respective backstop wall section and fall towards a downstream coin tube.
Figure 27:
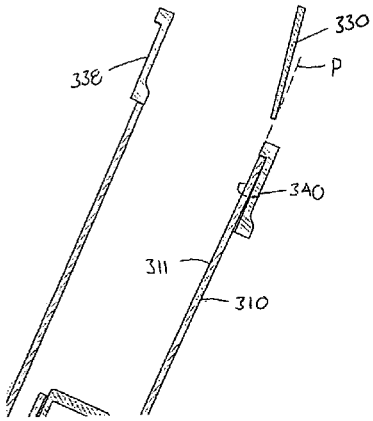
FIG. 27 is an enlarged, partial cross-sectional view of FIG. 21, illustrating a position of a deflection wall section.
Figure 28:
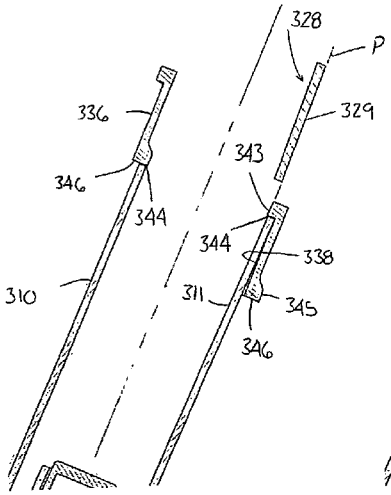
FIGS. 28-29 are enlarged, partial cross-sectional views of FIG. 21 illustrating alternate positions of one of the plurality of deflection wall sections.
Figure 29:
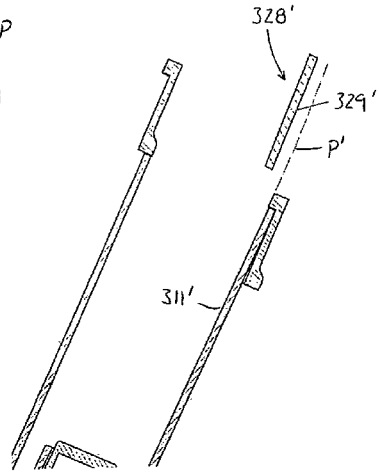

Each deflection wall section directs a coin into a respective coin tube. As shown in FIG. 21, the upstream most one of the plurality of deflection wall sections can extend generally parallel to a longitudinal axis of a corresponding coin tube 310. At least one downstream deflection wall section can extend at an acute angle relative to the upstream most one of the plurality of deflection wall sections. As best shown in the depicted embodiment of FIG. 21, deflection wall section 328 can extend generally parallel to the longitudinal axes of the coin tubes. As shown in FIG. 28, a forward most surface 329 of deflection wall section 328 defines a plane which is approximately coplanar with a plane P defined by a forward most inside surface 311 of the coin tube. Alternatively, as shown in FIG. 29, the forward most surface 329' can be offset from the plane P'. With reference again to FIG. 21, and additional reference to FIG. 27, each descending deflection wall section 330-334 can extend at an acute angle relative to deflection wall section 328 and the inner surface coin tube plane P. It should be appreciated that the acute angle of the deflection wall sections 330-334 can prevent the coins from falling into the corresponding coins tubes at an angle other than normal to a longitudinal axis of each of the plurality of coin tubes. However, it should be appreciated that all four of the deflection wall sections can have the same shape. Thus, they could all look like deflection wall section 328 illustrated in FIG. 28, or like deflection wall section 328' shown in FIG. 29, or like deflection wall section 330 illustrated in FIG. 27.

The coin slide 282 further includes a depending flange 336 and a plurality of backstop wall sections 338, 340, and 342 associated with the plurality of rows of coin tubes. A downstream most row of coin tubes may not have a backstop wall section associated with it. As best illustrated in FIG. 28, an upper portion 343 of each backstop wall section extends over an upper edge 344 of a respective one of the plurality of coin tubes 310. The upper edge of each backstop wall section is at least as thick as a thickest one of the coins meant to be sorted. A lower portion 345 of each backstop wall section and the flange 336 is thickened directly above a lower surface 346 of the back stop wall section. The lower surface 346 engages the upper edge 344 of a respective coin tube.

Figure 10:
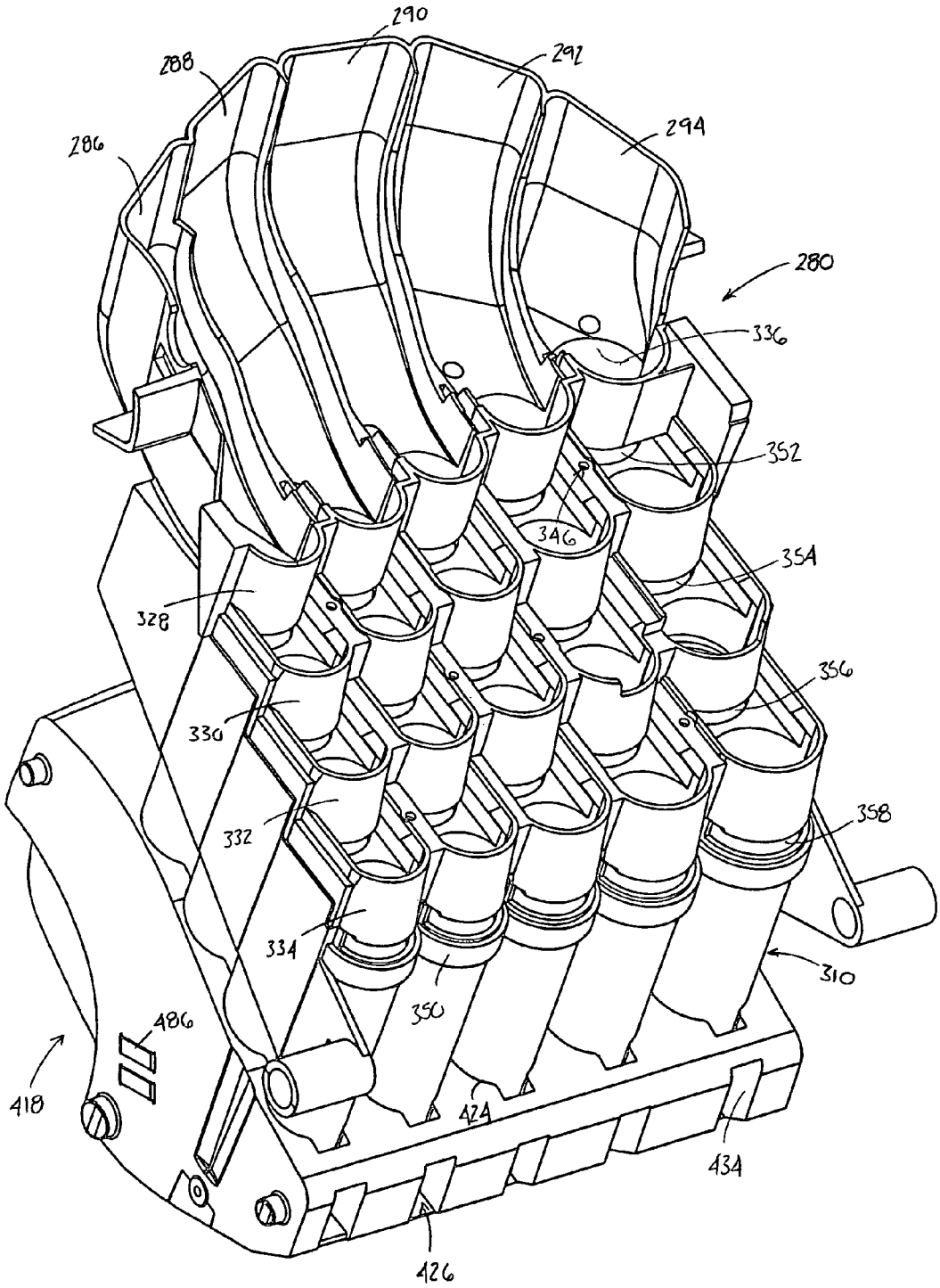
FIG. 10 is an enlarged perspective top view of the coin slide structure and the shaker box of FIG. 8 in an operable position.
Figure 10A:
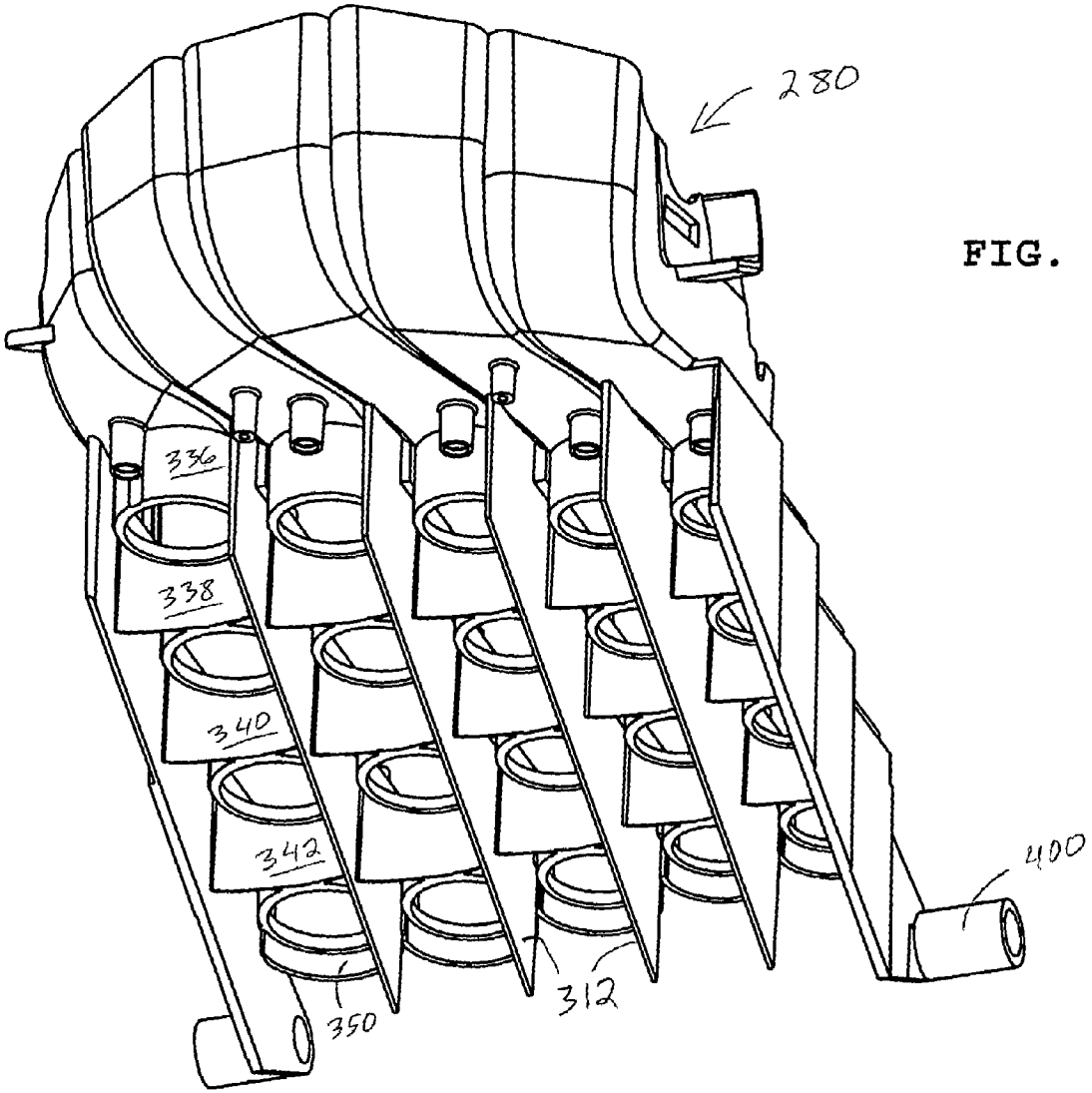
FIG. 10A is an enlarged bottom perspective view of the coin slide structure of FIG. 10.
Figure 25:
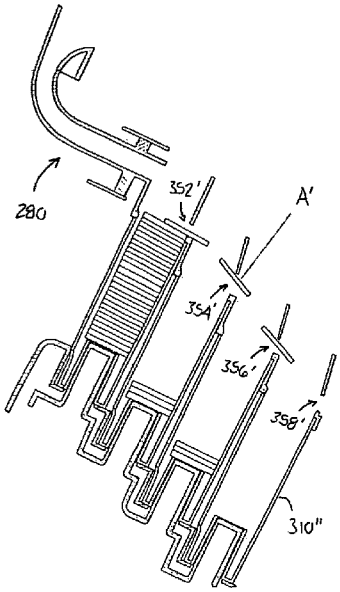
FIG. 25 is a cross-sectional view of FIG. 13 showing problems associated with a large deflector opening.
Figure 26:
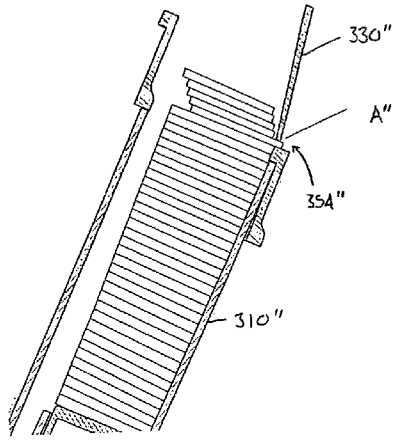
FIG. 26 is an enlarged, partial cross-sectional view of FIG. 13 showing problems associated with a small deflector opening.

With reference now to FIGS. 10, 10A and 21, each deflection wall section 328, 330, 332 (FIG. 10) is spaced from a respective backstop wall section 338, 340, 342 (FIG. 10A) and deflection wall section 342 is spaced from an end wall section 350 of coin slide 282. As shown in FIG. 21, this spacing defines exit apertures 352, 354, 356, and 358 which allow an excess or extra coin A, B, C (a coin on top of the top most coin in the coin tube) located above an upstream full coin tube to move to an adjacent downstream coin tube in the column of coin tubes of one denomination. The dimensions of each exit aperture can be generally greater than a thickness of at least two of the thickest associated sorted coins. In addition, the height of the deflection wall sections 328-334 help prevent jamming in the exit apertures. With reference to FIG. 25, if the dimension of the exit aperture 352', 354', 356', 358' is too large, a coin A' can skip an intended coin tube landing in an unintended coin tube, causing an undesired result of one or more partially full coin tubes. With reference to FIG. 26, if the dimension of the exit aperture is too small (e.g., a height of deflection wall section 330" is too large causing a small exit aperture 354"), excess coins A" can jam at the exit aperture.

When coins have completely filled an upstream coin tube, the excess coin will be aligned with the exit aperture. At this point, due to the descending angle at which the coins are held, the force of gravity will overcome friction and urge the excess coin to slide out through the exit aperture. This coin will contact a deflection wall section and fall toward a downstream coin tube or into an excess area of the coin housing. Thus, the descending levels of coin tubes allow a coin to travel away from an upstream row of coin tubes and contact a respective deflection wall section of a next downstream row of coin tubes.

The wall assembly 316 can be attached to the coin slide 282 by conventional fasteners (not shown) which extend through mounting apertures 346 located on the wall assembly and threadedly engage bosses 348 located on the coin slide.

With reference again to FIG. 5, a cover 360 can be pivotally mounted on the coin slide 282. The cover is selectively pivotable in relation to the coin sliding surfaces 286-294 to permit access to a sliding surface of the coin slide. In particular, the cover includes a first arm 362 extending upwardly from a top surface 364 adjacent a first side edge 366 of the cover. The first arm engages a slotted opening 368 located on the coin slide surface 286 to releasably lock the cover in place. A second arm 370 extends outwardly from a second side edge 372. The second arm engages a first opening (not shown) located on a first side wall 374 of the wall assembly 316. The cover further includes a stem 376 extending outwardly from the first side edge 366 for engaging a second opening (not shown) located on a second side wall 378 of the wall assembly. In this regard, the cover 360 can pivot away from the coin slide 282. It should be appreciated that alternative means for pivotally mounting the cover are also contemplated. The cover further includes a back wall 380 mounted to the top surface 364. The back wall is generally arcuate and is spaced from the coin sliding surfaces. A top end 382 of the back wall abuts an underside of the lower wheel support 174 adjacent the series of spaced apertures 254. The back wall and the coin sliding surfaces define coin channels for directing the coins to the respective coin openings 300-308. One or more circuit boards CB, which are-electrically connected to the display panel component 130, can be secured to the cover 360.

As indicated above, the coin slide assembly 280 pivots outwardly from the coin bank housing 20 and away from the plurality of coin tubes 310 for clearing access to the plurality of coin tubes (FIG. 8). In particular, the coin slide 282 includes opposed side walls 388 and 390. A lowermost end portion of each side wall includes a stem 400. The stems are pivotally received in corresponding openings 404 (FIG. 1) located on each guiding member 120 and 122. As shown in FIG. 1, a second lock 408 is mounted to the side panel 28. The second lock 408 engages a flange 410 extending from the coin slide 282 to lock the coin slide assembly to the housing 20.

Figure 6:
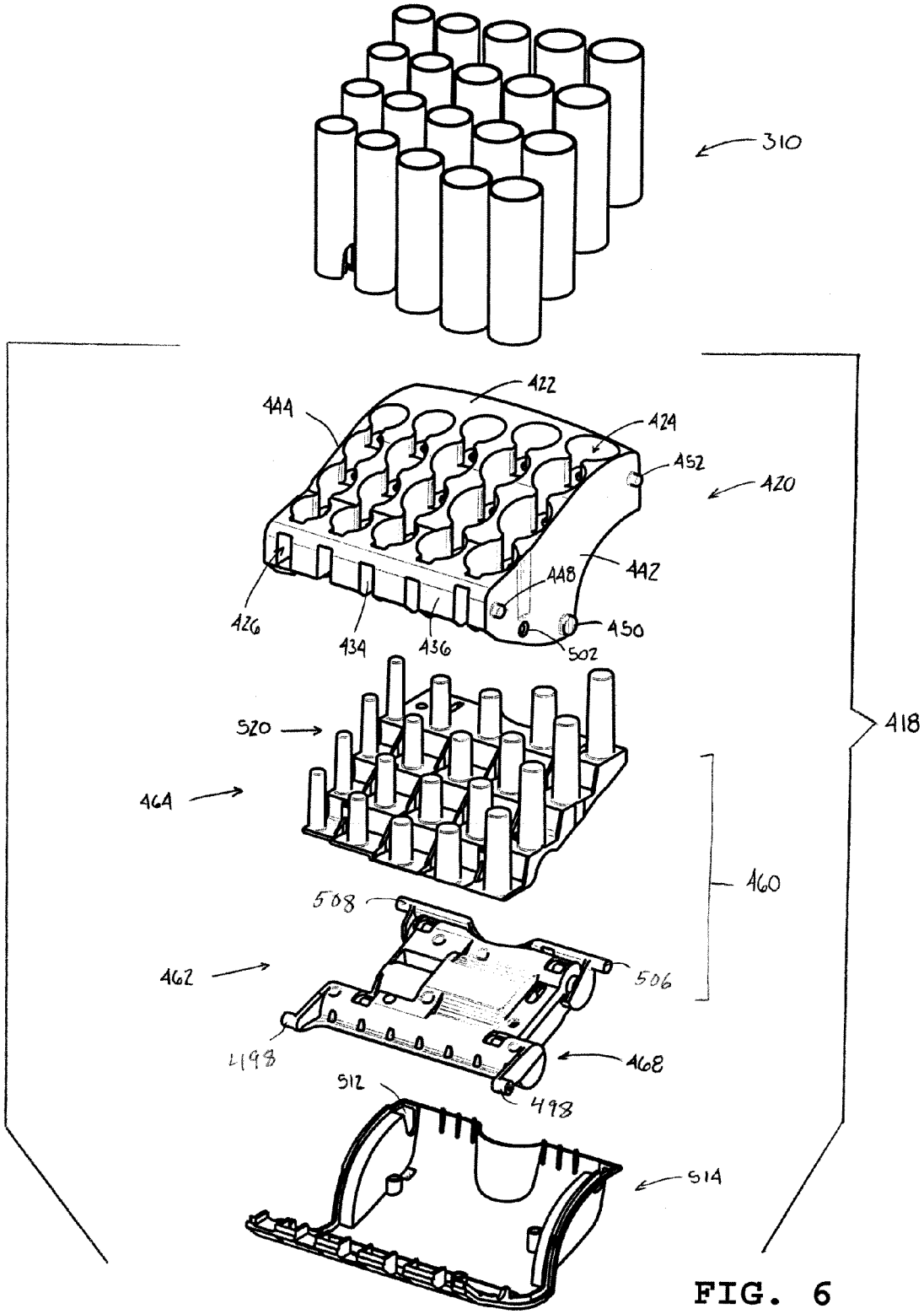
FIG. 6 is an enlarged exploded rear perspective view of a shaker box of the coin bank of FIG. 1 including a coin tube support member and a shaker mechanism.

With reference to FIG. 6, the coin bank 10 further includes a shaker box or support member 418 slidably and pivotally mounted in the housing 20. The shaker box comprises a support element 420 including a top surface 422 having plurality of recessed areas 424 dimensioned to receive the plurality of coin tubes 310. As shown in FIG. 10, the plurality of coin tubes is inclined in relation to a vertical axis for receiving sorted coins. The support element 420 further includes a plurality of coin paths 426, one coin path for each coin denomination. Each coin path has an exit opening 434 located on a front or lower end surface 436 for the support member. Each coin path directs a coin to an excess coin area 438 (FIG. 11) of the coin bank housing 20 when at least one coin tube for that denomination of coin is not mounted on support element 420. Side surfaces 442 and 444 (FIG. 8) of the support member include first and second pins 448 and 450, respectively. At least one side surface can also include a third pin 452. As will be described in greater detail below, and as shown in FIG. 18, the first and second pins 448, 450 are slidingly received in corresponding spaced apart first and second guides 454 and 456, respectively, located on each guiding member 120 and 122 which are secured to the respective side panels 26 and 28. The first and second pins and corresponding first and second guides allowing the support member to be slidably and pivotally received in the coin bank housing 20. The third pin 452 is slidingly received in a corresponding third guide 458 located on at least one of the guiding members. The third pin orients the shaker box 418 to its operational position.

With continued reference to FIG. 6, a shaker mechanism 460 is operably connected to the support member. The shaker mechanism jostles coins held in the plurality of coin tubes 310 to retard the coins from assuming an orientation other than normal to a respective longitudinal axis of the coin tubes. The shaker mechanism includes a drive mechanism 462 operably connected to a reciprocating member 464. As will be described in greater detail below, the drive mechanism selectively urges the reciprocating member upwardly for engaging coins located in the plurality of coin tubes.

Figure 7:
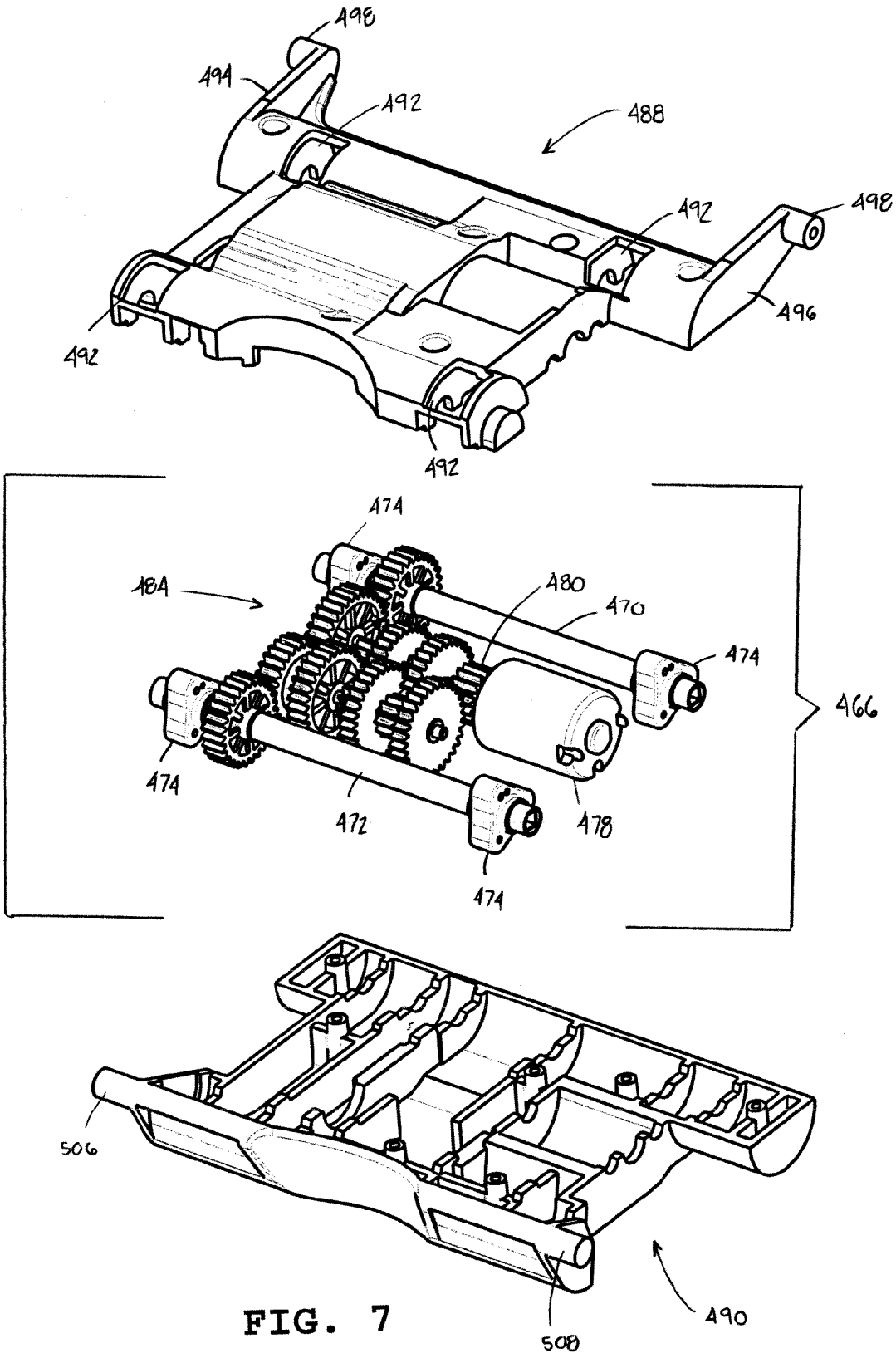
FIG. 7 is an enlarged exploded perspective view of a drive assembly of the shaker mechanism of the shaker box of FIG. 6.

As shown in FIGS. 6 and 7, the drive mechanism 462 includes a drive assembly 466 mounted in a housing 468. The drive assembly includes at least one drive shaft for rotating at least one cam which moves the reciprocating member. In the depicted embodiment, two drive shafts 470 and 472 are provided, each drive shaft including a pair of cams securely mounted to opposing ends of the shaft. Each cam has a generally triangular shape; although, this is not required. The drive assembly further includes an electric motor 478 including a drive shaft (not visible) and a spur gear 480 securely mounted to an end of the drive shaft and a gear train 484 therebetween. The drive mechanism is electrically connected to an external source of power via an electrical contact 486 (FIG. 8) on located on the second side surface 444 of the support member 420.

The housing 468 comprises first and second halves 488 and 490, respectively, which can be secured together via conventional fasteners. The first housing half 488 includes a plurality of cam openings 492 which allow a portion of each cam 474 to extend out of the housing 468 as the cams rotate on the drive shafts 470, 472. A pair of arms 494 and 496 having stems 498 extend from the first housing half 488. The stems are rotatably received in apertures 502 located on the side surfaces 442, 444 of the support member 420. The second housing half 490 includes a pair of posts 506 and 508. The posts are received in openings 512 located on a bottom cover 514 which is attached to a bottom portion of the support member 420.

Figure 9:
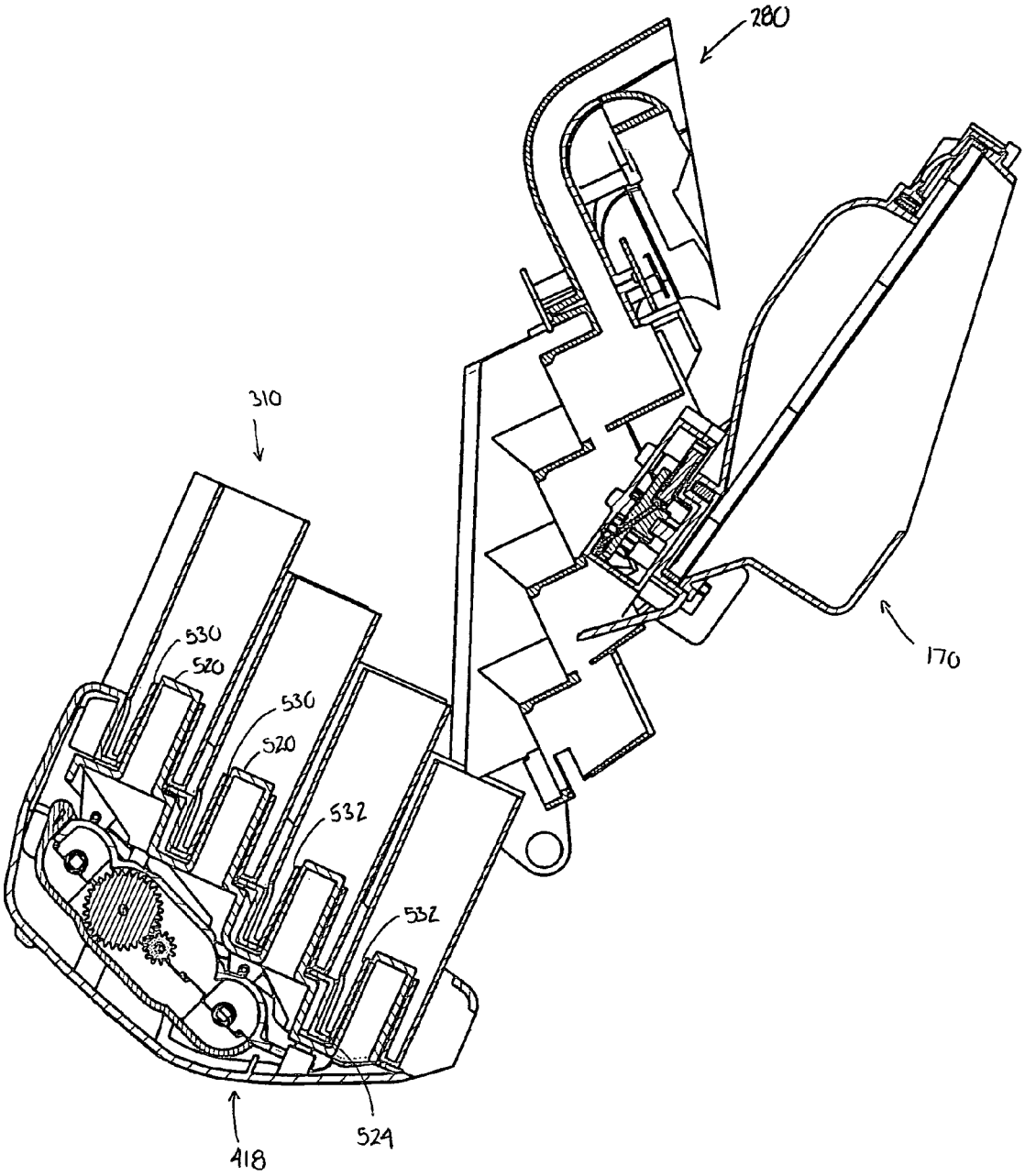
FIG. 9 is a cross-sectional view of FIG. 8.
Figure 30:
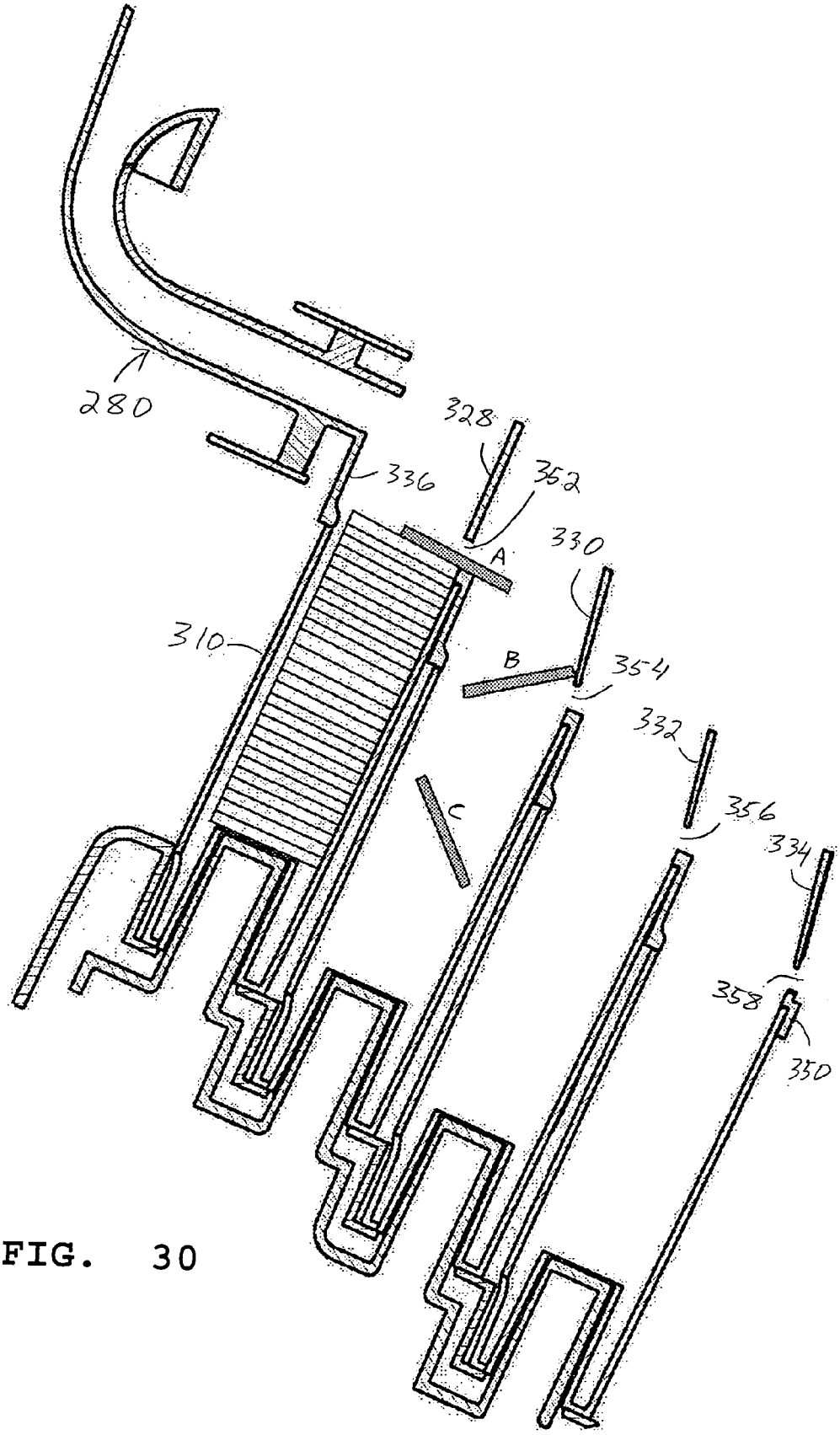
FIG. 30 is an enlarged cross sectional view of the coin slide structure, the shaker box and a column of descending coin tubes for the same denomination of coins of the coin bank of FIG. 1 in an assembled condition illustrating a movement of excess coins from a first filled coin tube to a second coin tube with the excess coins contacting a deflector and being redirected to the next coin tube in the column.
Figure 31:
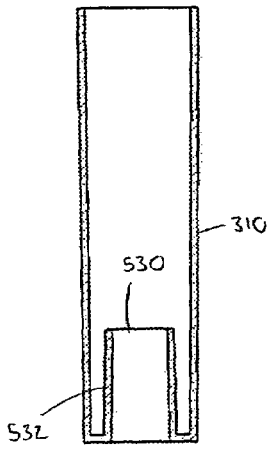
FIG. 31 is an enlarged cross-sectional view of a coin tube according to a first embodiment of the present invention.

With reference again to FIG. 6, the reciprocating member 464 is mounted beneath the plurality of coin tubes 310 and is displaceable relative to the plurality of coin tubes via the drive mechanism 462. The reciprocating member includes a plurality of protrusions 520. As shown in FIGS. 9 and 30-31, each protrusion projects through an opening 524 located on the support member 420. When engaged by the drive mechanism 462, the protrusions 520 project through openings 530 located in generally hollow pedestals 532 positioned at the lower ends of the coin tubes for engaging a bottom most one of the coins located in each of the plurality of coin tubes. Each pedestal 532 has a predetermined height for allowing a desired number of coins to be held in that coin tube. Thus, the protrusions 520 have varying heights to selectively projecting through the pedestals into a respective one of the plurality of coin tubes.

With reference now to FIGS. 11-17, the operation of the coin bank 10, particularly the operation and position of the shaker box 418 in the coin bank housing 20, will be discussed.

Figure 12:
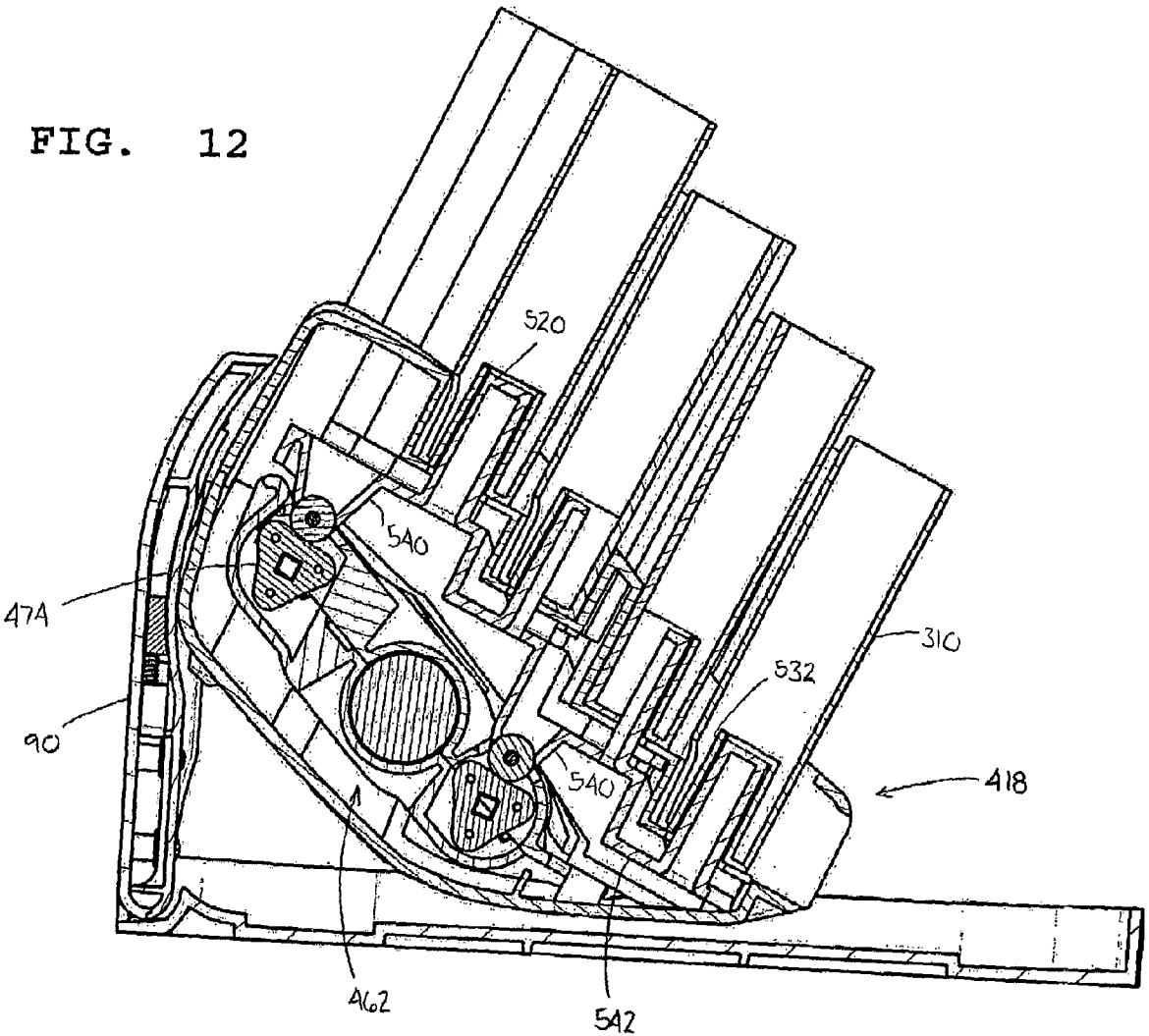
FIG. 12 is a cross-sectional view of the coin bank of FIG. 11 showing the shaker mechanism in a second position.

Assuming the component parts of the coin bank to be in the operational positions shown in FIGS. 11 and 12, the door assembly 90 is in the closed position and shaker box 418 is inclined in relation to a vertical axis so that the coin tubes 310, which are mounted on the support element 420, are positioned for receiving sorted coins. In this inclined positioned, deflection wall section 328 extends generally parallel to a longitudinal axis of the corresponding coin tube. Deflection wall sections 330-334 extend at an acute angle relative to deflection wall section 328. As shown in FIG. 11, the drive mechanism 462 is urging the reciprocating member 464 upwardly for engaging coins (not shown) located in the plurality of coin tubes 310. Particularly, the cams 474 engage feet 540 extending from a bottom surface 542 of the reciprocating member 464. As the cams rotate, the feet 540 are pushed upward. This upward movement moves the protrusions 520 vertically in the pedestals 532. A terminal portion of each protrusion projects out of each pedestal opening 530 and engages a bottom most one of the coins located in each of the plurality of coin tubes. As shown in FIG. 12, as the cams 474 continue to rotate, the feet 540 move downwardly, which in turn, moves the protrusions downwardly in the coin tubes 310. Thus, the shaker mechanism 460 vibrates the coins held in the plurality of coin tubes to retard the coins from assuming an orientation other than normal to a respective longitudinal axis of each of the plurality of coin tubes. This vibration also prevents coins from jamming at the coin exit apertures 352-358. Of course, a variety of cam shapes are contemplated.

Figure 13:
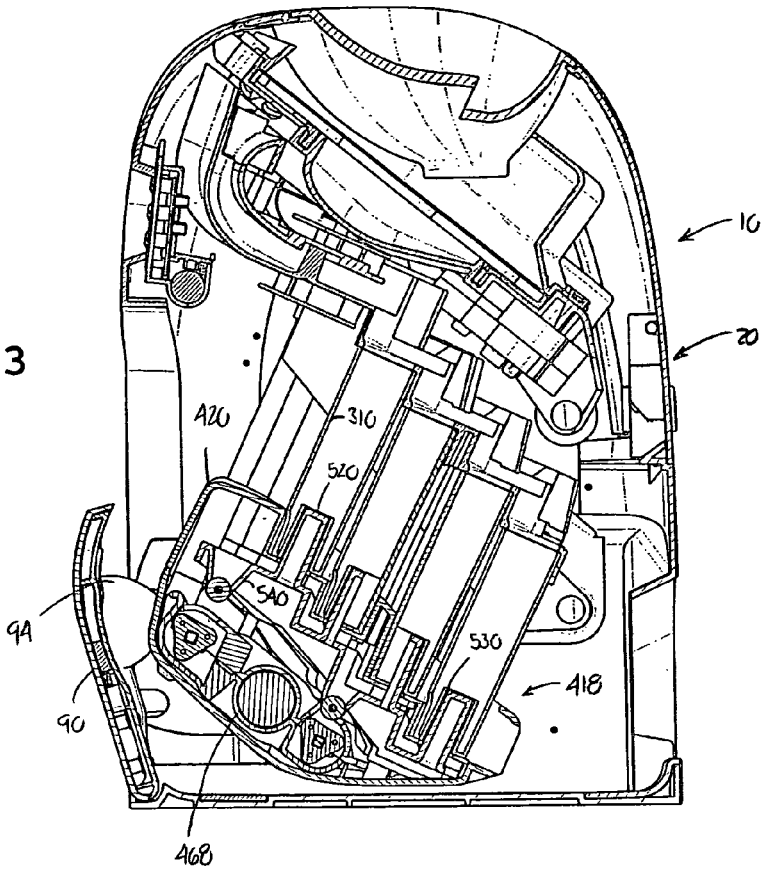
FIG. 13 is a cross-sectional view of an assembled coin bank of FIG. 1 showing a door, which is pivotally mounted to a housing of the coin bank, in a first, partially opened position.

With reference to FIG. 13, the door assembly is in a first, partially opened position which, in turn, drops the protrusions 520 of the reciprocating member 464 below the pedestal openings 530. Particularly, and as discussed previously, and as best seen in FIG. 6, the drive mechanism 468 is pivotally mounted to the support member 420 via the stems 498 which are mounted in the support member apertures 502. In the closed position, the door projections 94 engage the posts 506, 508 of the drive mechanism and push the posts upwardly in the openings 512 located on the bottom cover 514. This pivots the drive mechanism 468 into engagement with the reciprocating member 464, specifically the cams 474 into the feet 540. As the door assembly is opened, the door projections 94 move away from the posts 506, 508 thereby allowing the drive mechanism to pivot downwardly, by gravity, away from the reciprocating member. This keeps the volumetric count in each coin tube 310 accurate. In other words, the coin count is determined by the differential between the top surface of the coin tube and the top surface of the pedestal 532. If the protrusions 520 did not drop below the pedestal, the coin in the coin tubes could be inaccurate.

Figure 14:
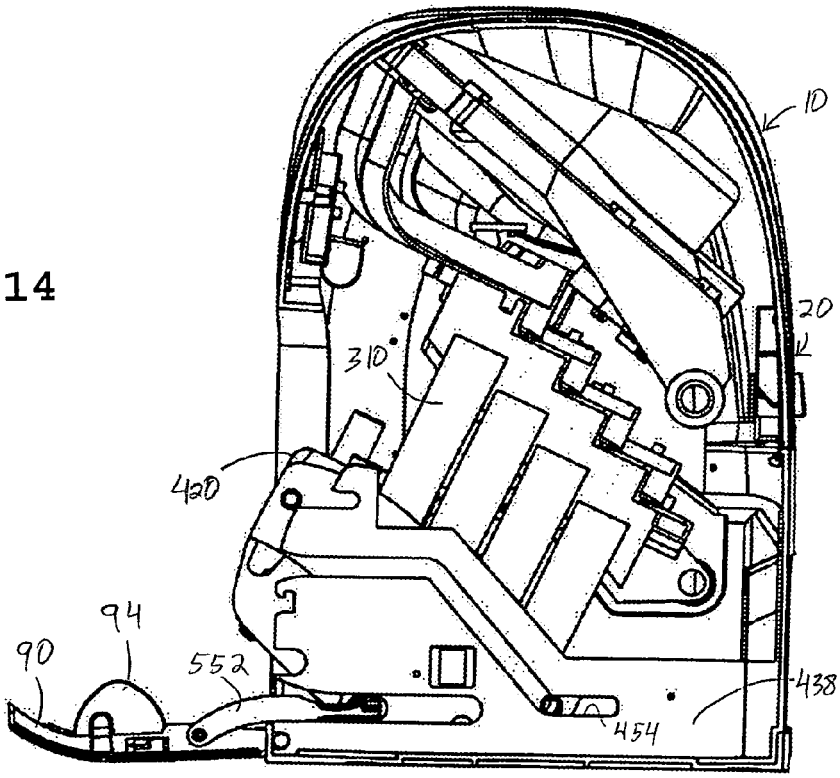
FIG. 14 is a cross-sectional view of the coin bank of FIG. 13 showing the door in a second partially open position, the door contacting and at least partially moving the shaker box such that the coin tubes are moved away from the coin slide structure.

With reference to FIG. 14, the door assembly 90 is in a second partially opened positioned. The door assembly further includes at least one arm for engaging the support element 420, wherein as the door is being opened, the at least one arm at least partially removes the support member from the coin bank housing 20. In this embodiment, the door assembly includes a pair of arms 550 and 552 (FIG. 2) which are pivotally mounted to the door plate 92. As shown in FIG. 18, a finger 554 of each arm, which can have an arcuate shape 560, is slidably received in the guides 456 of the guiding members 120, 122. As the door is being opened, each arm 550, 552 engages the pins 450 of the support element 420 and slidably moves the support member relative to the guiding members. In the position of FIG. 14, the coin tubes 310 are partially moved away from the coin slide 282, however, the inclined orientation of the coin tubes remains the same. This allows any excess coins to fall into either an adjacent coin tube which is of the same denomination but is not yet full, or the excess coin area 438.

Figure 19:
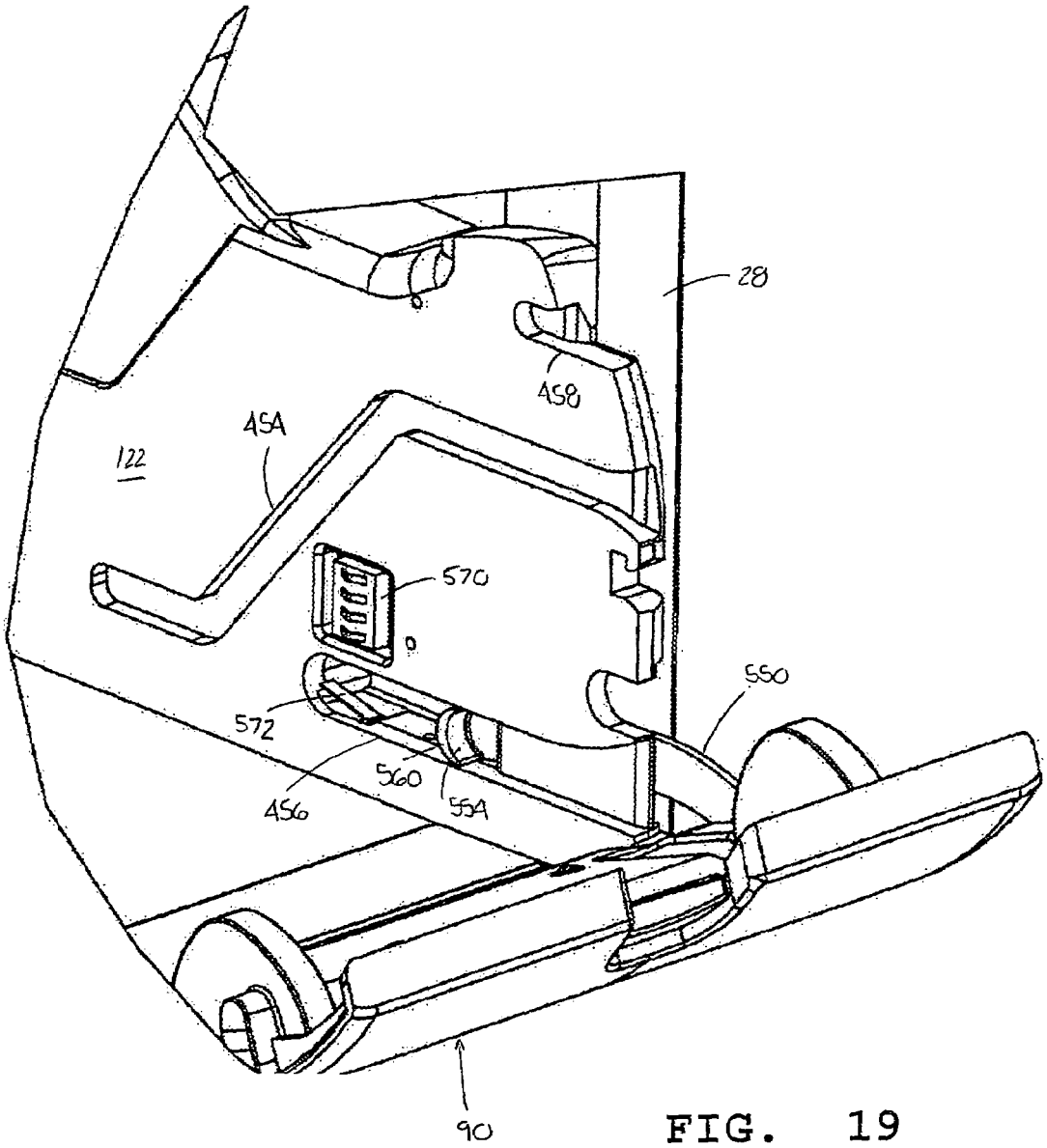
FIG. 19 is an enlarged partial perspective view of an assembled coin bank of FIG. 1 illustrating the door in an open position, a switch for activating and de-activating the coin separating and sorting assembly and the shaker box and electrical contacts for the shaker box.
Figure 20:
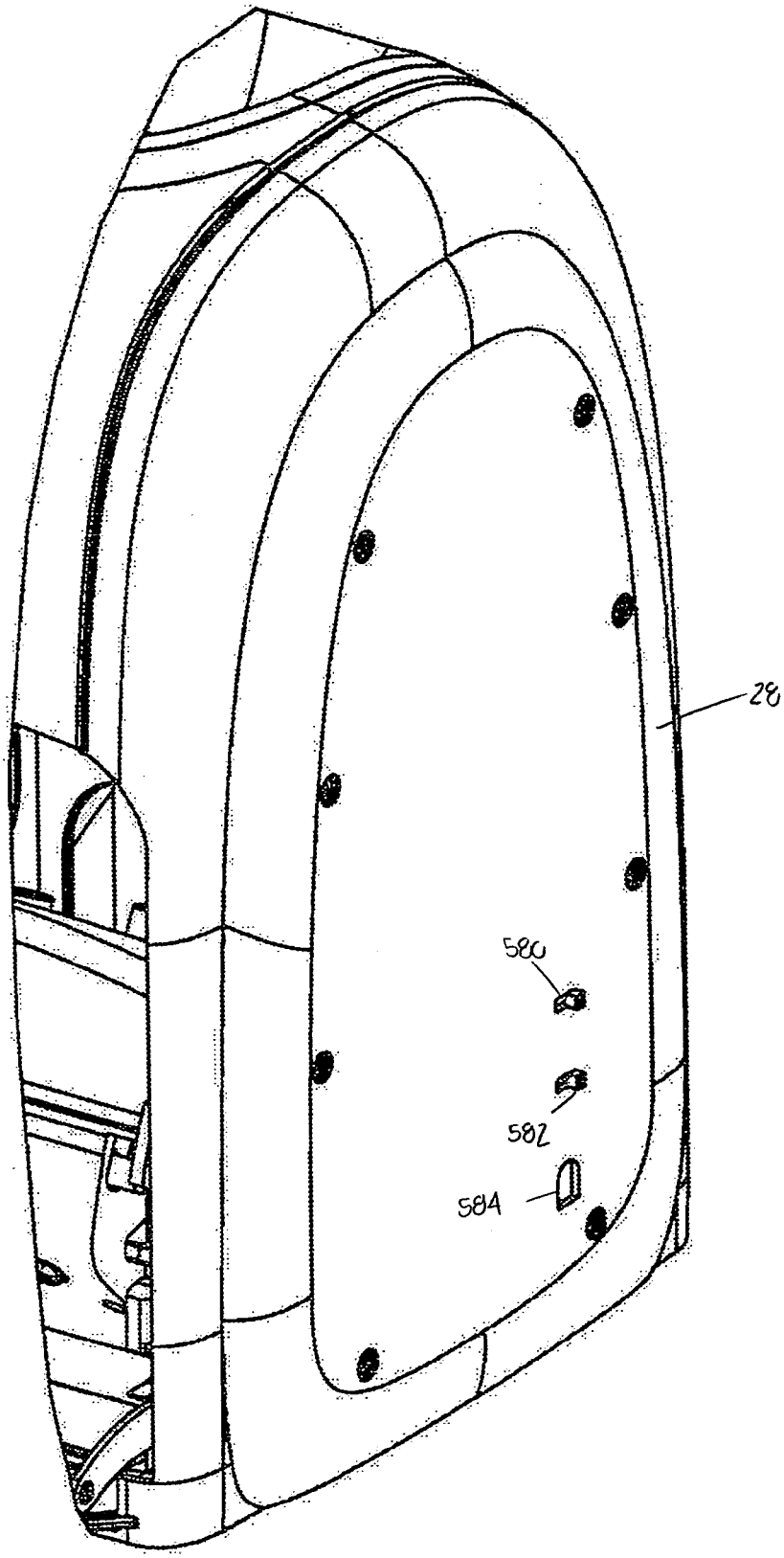
FIG. 20 is an enlarged perspective view of one side of the coin bank of FIG. 1, in an assembled condition, with the remainder of it broken away, showing an on/off switch for the shaker box, an A/B switch for the coin separating and sorting assembly and an opening for receiving a power jack.

The movement of the shaker box 418 disengages the electrical contact 486 (FIG. 8) of the drive mechanism 462 located on the second side surface 444 of the support element 420 from an electrical contact 570 (FIG. 19) located on guiding member 122 secured to side panel 28. The outward movement of the shaker box also deactivates a switch 572 (FIG. 19). The switch 572 selectively supplies electric power to the drive unit 180 for actuating the coin sorting assembly 170 and the drive mechanism 462 for actuating the shaker box 418. When the door 90 is opened, the switch 572 is tripped to disable the drive unit and the drive mechanism. Connected to the switch 572 are an A/B switch 580 for controlling the speed of the coin separating wheel 176 and an on/off switch 582 for the shaker box 418. As shown in FIG. 20, the A/B switch, the on/off switch and an opening 584 for receiving a power jack are located on the side panel 28.

Figure 22:
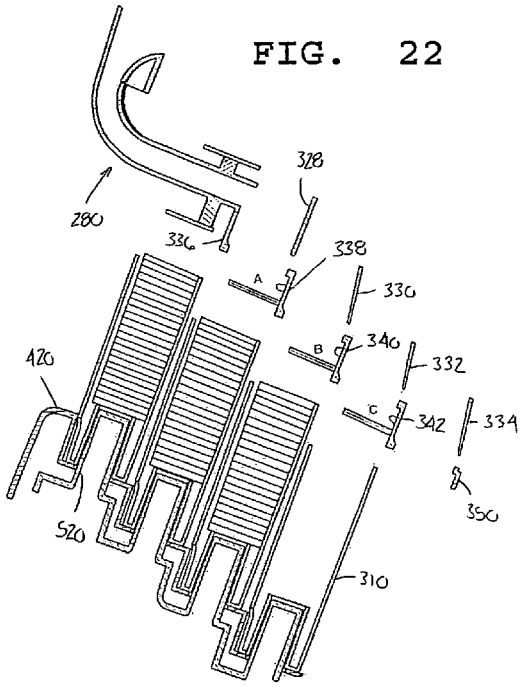
Figure 23:
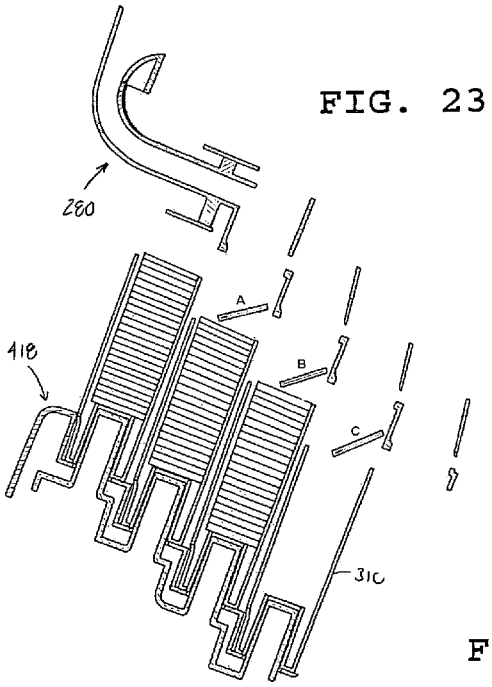
Figure 24:
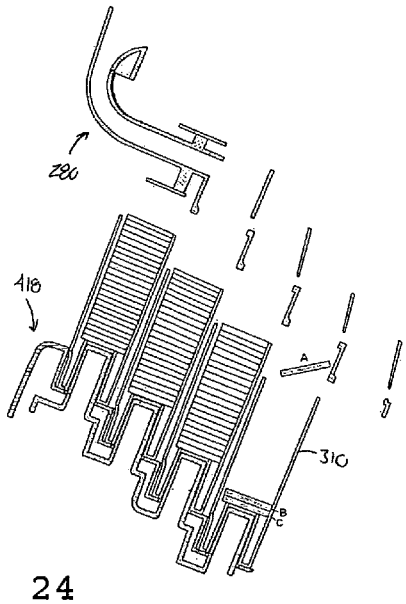

An example of the operation of the coin bank 10 described above relative to FIGS. 13 and 14 is schematically illustrated in FIGS. 21-24. As shown in FIG. 21, the plurality of rows of coin tubes are located adjacent the backstop wall sections. Excess coins A, B, C are retained in three of the four illustrated descending coin tubes by the upper portion 343 or each retention area. Respective backstop wall sections 338, 340, 342 are associated with the coin retention area. As shown in FIG. 22 and FIG. 14, when the door assembly 90 is opened and support element 420 is in a second position, the plurality of rows of coin tubes are generally offset from the backstop wall sections. As the support element 420 moves, the excess coins A, B, C also being to move and contact their respective backstop wall section 338, 340, 342. As shown in FIG. 23, excess coin A falls toward the next downstream coin tube of the same denomination. If the next downstream coin tube contains less than its predetermined amount of coins, then excess coin A will fall into this coin tube. But, if the coin tube has reached its predetermined amount, as shown in FIGS. 23 and 24, excess coin A will continue to fall by gravity and hit a next and downstream backstop and fall toward that backstop's respective coin tube. This process continues until excess coin A finds a coin tube that does not contain its predetermined amount of coins. The same is true for excess coin B. Excess coin C hits its respective backstop 342 and falls into a lowermost, empty coin tube. As shown in FIG. 24, the uppermost coin in each downstream full coin tube creates a stepped surface. This allows excess coins A and B to continue to slide downwardly and toward a coin tube which can accommodate them, in this case, a lowermost empty coin tube.

Figure 15:
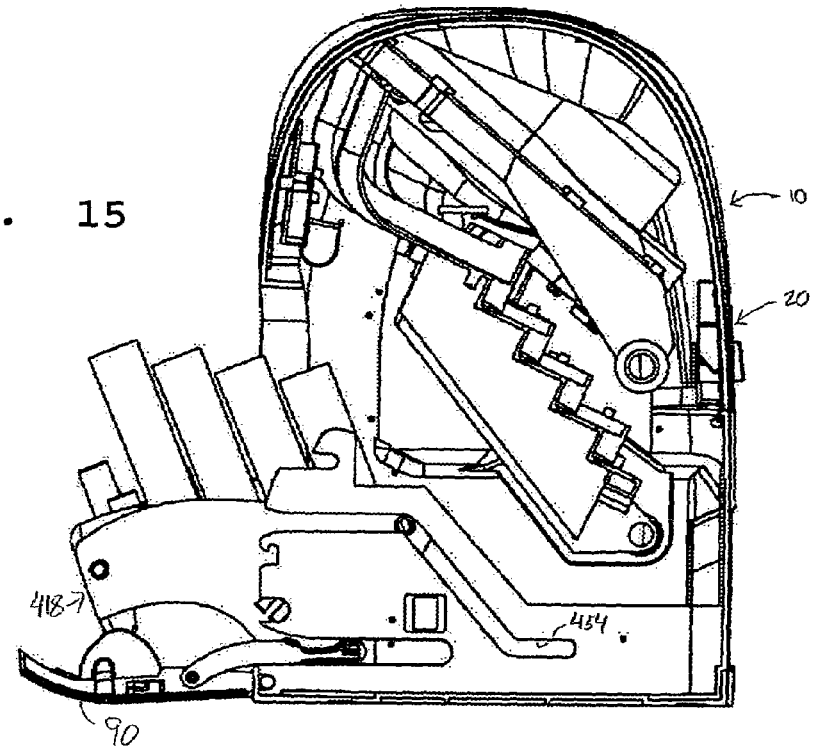
FIG. 15 is a cross-sectional view of the coin bank of FIG. 13 showing the door in a third partially open position, wherein at least some rows of the coin tubes are accessible.

With reference to FIG. 15, the shaker box 418 is allowed to pivot from its inclined angle to a generally horizontal, third, position and can be moved at least partially out of the coin bank housing 20. In this position, several rows of the coin tubes 310 are accessible. The door assembly can include a stop (not shown) for maintaining the shaker box in this position.

Figure 16:
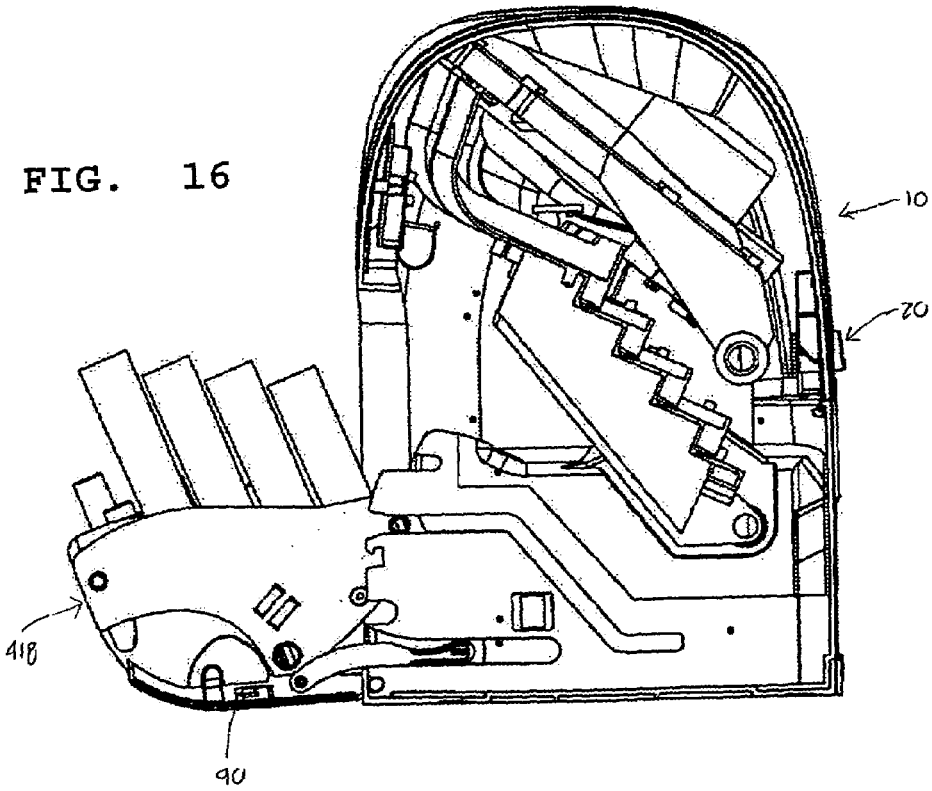
FIG. 16 is a cross-sectional view of the coin bank of FIG. 13 showing the door in a fourth open position, wherein all rows of the coin tubes are accessible.
Figure 17:
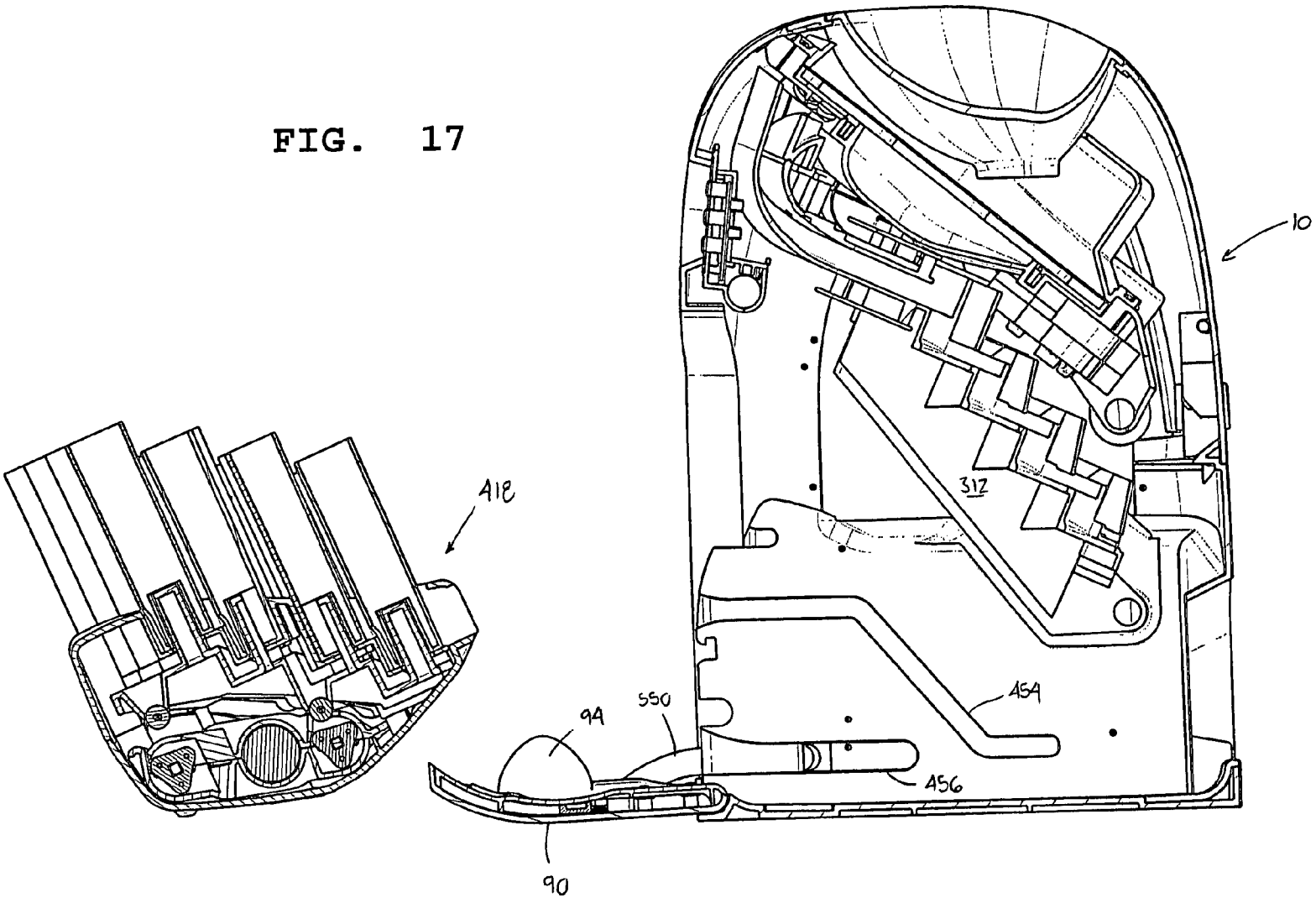
FIG. 17 is a cross-sectional view of the coin bank of FIG. 13 showing the shaker box completely removed from the coin bank.

With reference to FIG. 16, the support member or shaker box 418 moves from its generally horizontal position to a, fourth, forwardly inclined angle. The shaker box can now be moved out of the interior of the coin bank housing 20. In this position, all the of the coin tubes 310 are accessible. The door assembly can include a stop (not shown) for maintaining the shaker box in this position. Finally, as shown in FIG. 17, the shaker box can be completely removed from the coin bank 10.

With reference now to FIG. 30, the use of the deflection wall sections is there illustrated. When an excess coin above a filled first tube 310 travels through an exit aperture 352, it will strike a second deflection wall section 330. The deflection wall section 330 will redirect the coin in a downward direction and towards the next downstream coin tube. If that coin tube is not full, as is illustrated, the excess coins A, B and C will then be accommodated in that coin tube. In a similar manner, once the next downstream coin tube is full, any excess coins above the second full coin tube will slide through the second exit aperture 354 and strike the third deflection wall section 332. Once all four coin tubes are full, any excess coins will exit at aperture 358 and fall to the excess coin area of the instant coin bank.

As it relates to the volumetric count in each coin tube, it should be appreciated that the coin count could be determined by alternate constructions of coin tubes and a shaker box.

Figure 33:
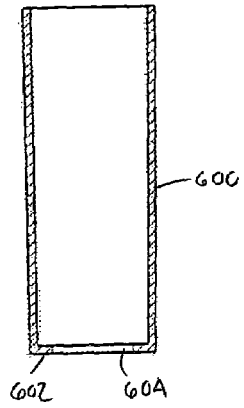
FIG. 33 is an enlarged cross-sectional view of a coin tube according to a second embodiment of the present invention.
Figure 34:
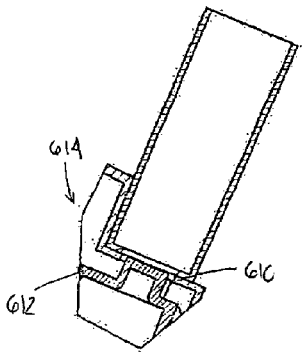
FIG. 34 is a cross-sectional view of the coin tube of FIG. 33 cooperating with a second embodiment of a shaker box, partially broken away.

As shown in FIGS. 33 and 34, a coin tube 600 includes a bottom surface 602 having an opening 604 dimensioned to receive a protrusion 610 of a reciprocating member 612 of a shaker box 614. The protrusion has a predetermined height such that as a door of the coin bank is opened, the protrusions would drop below the bottom surface. The coin count is determined by the differential between the top surface of the coin tube and the bottom surface of the coin tube. In this embodiment, if the protrusions 610 did not drop below the bottom surface 602, the coin count in the coin tubes could be inaccurate.

Figure 35:
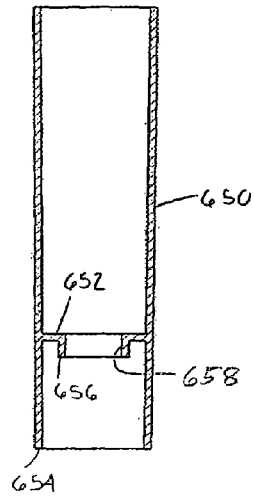
FIG. 35 is an enlarged cross-sectional view of a coin tube according to a third embodiment of the present invention.
Figure 32:
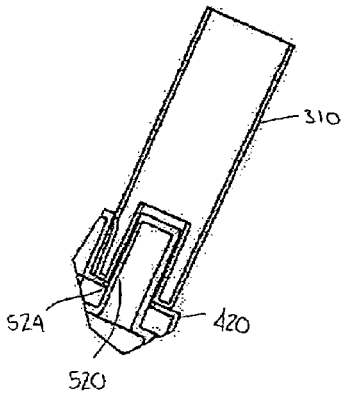
FIG. 32 is a cross-sectional view of the coin tube of FIG. 31 cooperating with the shaker box of FIG. 1, partially broken away.
Figure 36:
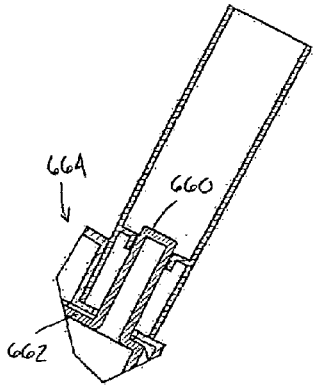
FIG. 36 is a cross-sectional view of the coin tube of FIG. 33 engaged by a third embodiment of a shaker box, partially broken away.

Another embodiment is illustrated in FIGS. 35 and 36. In this embodiment, a coin tube 650 includes a shelf 652 located a predetermined distance above a bottom edge 654 of the coin tube. The shelf includes a downwardly extending flange 656 defining an opening 658 dimensioned to receive a protrusion 660 of a reciprocating member 662 of a shaker box 664. In this alternative embodiment, as a door of the coin bank is opened, the protrusion would drop below the shelf. The coin count is determined by the differential between the top surface of the coin tube and the top surface of the shelf.

Figure 37:
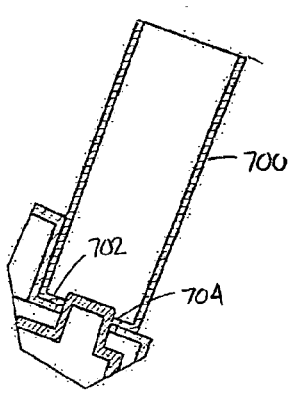
FIGS. 37 and 38 are cross-sectional views of the coin tube of FIG. 33 engaged by a fourth embodiment of a shaker box, partially broken away.
Figure 38:
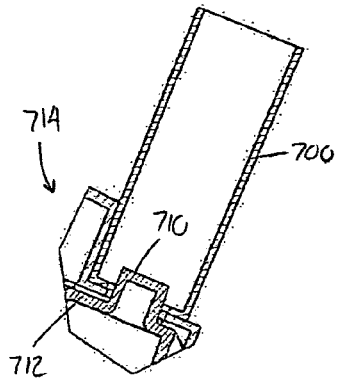

As shown in FIGS. 37 and 38, a coin tube 700, according to a further embodiment, includes a bottom surface 702 having an opening 704 dimensioned to receive a protrusion 710 of a reciprocating member 712 of a shaker box 714. In this alternative embodiment, as a door of the coin bank is opened, the protrusions would assume a predetermined distance above the bottom surface 702. The coin count is determined by the differential between the top surface of the coin tube and the top surface of the protrusion.

Figure 39:
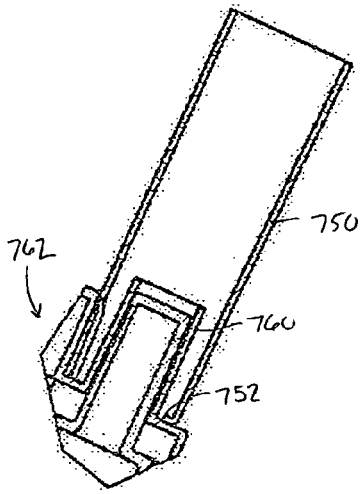
FIGS. 39 and 40 are enlarged cross-sectional views of a coin tube according to a fourth embodiment of the present invention engaged by a fifth embodiment of a shaker box, partially broken away.
Figure 40:
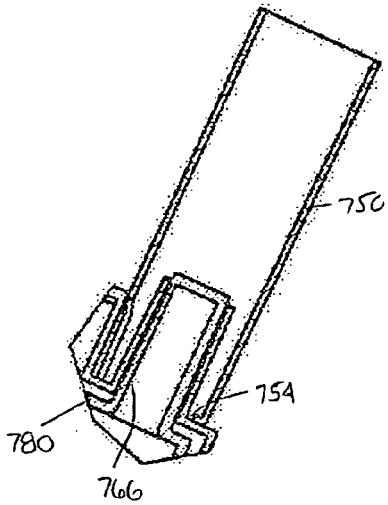

A still further embodiment is illustrated in FIGS. 39 and 40. In this embodiment, a coin tube 750 includes an inwardly extending lip 752, which defines an opening 754 for receiving a pedestal 760. The pedestal is integrally formed with and extends upwardly from a shaker box 762. The pedestal is dimensioned to receive a protrusion 766 of a reciprocating member 780 housed in the shaker box. In this alternative embodiment, as a door of the coin bank is opened, the protrusion would drop below the top of the pedestal, as shown in FIG. 39. The coin count is determined by the differential between the top surface of the coin tube and the top surface of the pedestal.

The present invention has been described with reference to the several embodiments shown. Obviously, modifications and alterations will occur to others upon reading and understanding the preceding detailed description. It is intended that the present invention be construed as including all such modifications and alterations insofar as they come within the scope of the appended claims or the equivalents thereof.

What we claim is:

1. A coin bank comprising:

a housing;

a coin sorting mechanism mounted to said housing;

at least two rows of coin tubes, for holding associated sorted coins, selectively positioned in said housing, each row comprising a plurality of coin tubes meant for holding sorted coins of multiple denominations, wherein a plurality of columns of coin tubes, each holding one denomination of associated sorted coins is defined, said coin tubes in each column being positioned at descending levels;

a support member for selectively holding said at least two rows of coin tubes, said support member being slidably mounted to said housing so that the coin tubes at the lowest descending level are slidingly received first in said housing;

at least two deflector wall sections mounted to said housing, each of which is positioned generally above a respective one of said at least two rows of coin tubes, each deflector wall section directing a coin into a respective coin tube; and, a respective exit aperture defined below a lower edge of each respective deflector wall section and above an upper edge of a respective coin tube, wherein the descending levels of coin tubes allow a coin to travel away from a first row of coin tubes and contact a respective deflector wall section of a next row of coin tubes.

2. The coin bank of claim 1, further comprising a backstop wall section mounted to said housing, wherein an upper portion of said backstop wall section extends over an upper edge of a respective one of said plurality of coin tubes, said upper edge of said backstop wall section being at least as thick as a thickest one of the associated coins meant to be sorted.

3. The coin bank of claim 2, wherein a lower end of said backstop wall section is thickened directly above a lower face engaging an upper end of a respective coin tube.

4. The coin bank of claim 1, wherein a first of said at least two deflector wall sections is oriented parallel to a longitudinal axis of a first one of said at least two rows of coin tubes.

5. The coin bank of claim 1, wherein a second of said at least two deflector wall sections has an orientation at an acute angle to a longitudinal axis of a second one of said at least two rows of coin tubes.

6. A coin bank comprising:

a housing for receiving unsorted coins;

a coin sorting assembly mounted in said housing;

a support member mounted in said housing;

a plurality of coin tubes selectively mounted on said support member including at least one coin tube for each denomination of coins to be sorted, wherein said support member has a coin receiving orientation in which said plurality of coin tubes are not accessible by a user and a coin removal orientation in which said plurality of coins tubes are accessible by a user;

an agitator mechanism operably connected to said support member and including a protrusion, wherein when said support member is in the coin receiving orientation, said agitator mechanism protrusion selectively engages a bottom most one of a set of associated coins held in at least one of said plurality of coin tubes to retard the associated coins from assuming an orientation other than approximately normal to a longitudinal axis of the respective coin tube; and a door mounted to said housing and engaging said support member, wherein as said door is being opened, said support member is at least partially removed from said housing.

7. The coin bank of claim 6, wherein said support member includes a plurality of recessed areas dimensioned to receive said plurality of coin tubes.

8. The coin bank of claim 7, wherein said agitator mechanism is housed in said support member.

9. The coin bank of claim 8, wherein said agitator mechanism includes a reciprocating member mounted beneath said plurality of coin tubes, said reciprocating member being displaceable relative to said plurality of coin tubes.

10. The coin bank of claim 9, wherein said reciprocating member includes a plurality of protrusions, each protrusion projecting through an opening located in a respective coin tube.

11. The coin bank of claim 10, wherein each coin tube has a predetermined height for allowing a desired number of coins to be held in that coin tube when said reciprocating member is spaced from the bottom most one of the associated coins.

12. The coin tube of claim 10 further comprising a door mounted to said housing, wherein said protrusions retract when said door is opened.

13. The coin bank of claim 6, wherein said support member includes a plurality of coin paths, one coin path for each coin denomination, each coin path directing an associated coin to an excess coin storage portion of said housing when at least one coin tube for the associated coin is not mounted on support member.

14. The coin bank of claim 6, wherein said agitator mechanism further includes a drive assembly operably connected to a reciprocating member, said drive assembly urging said reciprocating member upwardly for engaging associated coins located in said plurality of coin tubes.

15. The coin bank of claim 14, wherein said drive assembly includes at least one drive shaft for rotating at least one cam, said cam moving said reciprocating member.

16. The coin bank of claim 6, wherein said support member further includes first and second pins, said pins being slidingly received in corresponding spaced apart guides located on said housing, said pins and corresponding guides allowing said support member to be slidably received in said housing.

17. The coin bank of claim 6, wherein said agitator mechanism is mounted in said support member and said support member includes an electrical contact electrically connected to an external source of power and a drive mechanism mounted in said agitator mechanism.

18. The coin bank of claim 6, wherein said door is pivotally mounted to said housing, said door including an arm for engaging said support member, wherein as said door is being opened, said arm at least partially removes said support member from said housing.

19. The coin bank of claim 18 further comprising a switch for selectively supplying electric power to a first motor for actuating said coin sorter assembly and a second motor for actuating said agitator mechanism, wherein when said door is opened, said switch is tripped to disable said first and second motors.

20. A coin bank comprising:

a housing including a coin receiving area for receiving associated unsorted coins;

a coin sorting assembly movably mounted in said housing and located beneath said coin receiving area; and, a coin slide structure at least partially located beneath said coin sorting assembly, said coin slide including at least one coin sliding surface sloping from an upper end located adjacent said coin sorting assembly to a lower end, wherein said coin sorting assembly is movable away from said coin slide structure in order to permit access to said coin slide structure to allow for the clearing of coin jams located on said coin slide structure, wherein said coin slide structure is movably mounted in said housing to permit access to a plurality of coin tubes mounted to said housing.

21. The coin bank of claim 20, further comprising a removable shaker mechanism movably mounted in said housing beneath said coin sorting assembly.

22. The coin bank of claim 20, wherein said coin slide structure comprises a cover which is pivotally mounted on said coin slide structure, said cover being selectively pivotable in relation to said coin slide structure to permit access to a sliding surface of said coin slide structure.

23. The coin bank of claim 20, further comprising a first fastener for securing said coin slide structure to said housing.

24. The coin bank of claim 23, further comprising a second fastener for securing said coin sorting assembly to said housing.

25. A coin bank comprising:

a housing for receiving unsorted coins;

a coin sorting assembly pivotally mounted to said housing;

a removable support member slidably mounted to said housing;

a plurality of coin tubes selectively mounted to said support member, wherein said plurality of coin tubes are arranged in a plurality of rows for holding associated sorted coins, wherein said support member is movable to at least two positions with respect to said housing, a respective backstop associated with each of said plurality of rows of coin tubes, wherein a downstream-most row of coin tubes may not have a backstop associated with it, wherein in a first position, said plurality of rows of coin tubes are located adjacent to said respective backstop; and, wherein in a second position, said plurality of rows of coin tubes are generally offset from said first position, the movement of said support member from said first position to said second position allowing at least one retained coin located above an upstream coin tube of said plurality of rows of coin tubes to contact said respective backstop and fall towards a downstream coin tube of the same denomination in a downstream row of coin tubes.

26. The coin bank of claim 25, further comprising a plurality of spaced apart fins mounted to said housing above said columns of coin tubes and positioned between said columns of coin tubes for preventing a movement of coins of one denomination into adjacent coin tubes meant for coins of another denomination.

27. The coin bank of claim 25, further comprising a deflection wall section, wherein a lower end of each deflection wall section and a top surface of each backstop defines an exit aperture for directing a retained coin located above a full coin tube to an adjacent coin tube of the same denomination.

28. The coin bank of claim 27, wherein two deflection wall sections are provided, an upstream one of said deflection wall sections extends generally parallel to a longitudinal axis of a corresponding coin tube, and wherein a downstream one of said deflection wall sections extends at an acute angle relative to said upstream one of said deflection wall sections.

29. The coin bank of claim 25, wherein four rows of coin tubes are provided and wherein said support member includes four positions, in a third position, at least three rows of coin tubes are accessible, and wherein, in a fourth position, each row of said four rows of coin tubes is accessible.

30. The coin bank of claim 25, further comprising a door pivotally mounted to said housing, said door including an arm for engaging said support member, wherein as said door is being opened, said arm at least partially removes said support member from said housing.

31. The coin bank of claim 25, wherein said housing includes an excess coin storage portion, wherein in said second position, said excess coin storage portion is configured to receive a downstream most retained coin located above a downstream most coin tube of the same denomination in said downstream row of coin tubes.

* * * * *